United States Patent [19]

Pugh

[11] Patent Number: 4,955,355

[45] Date of Patent: Sep. 11, 1990

[54] ARROW HOLDING AND LOADING DEVICE FOR ARCHERY BOWS

[76] Inventor: Gregory E. Pugh, 13635 Leroy, Southgate, Mich. 48195

[21] Appl. No.: 336,016

[22] Filed: Apr. 10, 1989

Related U.S. Application Data

[63] Continuation-in-part of Ser. No. 76,798, Jul. 23, 1987, Pat. No. 4,823,762.

[51] Int. Cl.[5] ..... F41B 5/00; F41B 5/02; F41B 5/06

[52] U.S. Cl. ..... 124/52; 124/45; 124/53; 124/88; 124/25.7

[58] Field of Search ..... 124/23 R, 23 A, 24 R, 124/24 A, 25, 41 R, 41 A, 41 B, 45, 51 R, 52, 53, 82, 86, 88; 224/916

[56] References Cited

U.S. PATENT DOCUMENTS

| | | | |
|---|---|---|---|
| 2,214,224 | 9/1940 | Douglas . | |
| 2,245,187 | 6/1941 | Donash . | |
| 2,801,625 | 8/1957 | Vose . | |
| 2,909,167 | 10/1959 | Fredrickson . | |
| 2,980,097 | 4/1961 | Rothgery . | |
| 2,980,305 | 4/1961 | Reese . | |
| 2,984,277 | 5/1961 | Neff . | |
| 2,997,999 | 8/1961 | Crowder . | |
| 3,017,874 | 1/1962 | Gubash . | |
| 3,034,789 | 5/1962 | Moore . | |
| 3,116,730 | 1/1964 | Tingley . | |
| 3,406,675 | 10/1968 | Fredrickson . | |
| 3,527,195 | 9/1970 | Corio . | |
| 3,595,215 | 7/1971 | Wilkie et al. . | |
| 3,716,174 | 2/1973 | Ehlert . | |
| 4,038,960 | 8/1977 | Ludwig | 124/41 A |
| 4,247,027 | 1/1981 | Tardiff . | |
| 4,522,187 | 6/1985 | Tafel | 124/24 A |
| 4,541,403 | 9/1985 | DeBlois | 124/51 R |
| 4,823,762 | 4/1989 | Pugh | 124/52 |

FOREIGN PATENT DOCUMENTS

| | | |
|---|---|---|
| 1470802 | 4/1977 | United Kingdom . |

*Primary Examiner*—Randolph A. Reese
*Assistant Examiner*—John A. Ricci
*Attorney, Agent, or Firm*—Harness, Dickey & Pierce

[57] ABSTRACT

An arrow holding and loading device for an archery bow has a frame to be bolted to the bow so that it can support a carriage that moves horizontally from left to right at the arrow plate side of the riser, through a window in the arrow plate side of the riser, or to the rear of the riser to automatically shift a follow-up arrow into shooting position upon release by the archer of an initial arrow.

34 Claims, 17 Drawing Sheets

ARROW HOLDING AND LOADING DEVICE FOR ARCHERY BOWS

RELATED APPLICATION

This application is a continuation-in-part of may copending application Ser. No. 076,798, filed July 23, 1987, now U.S. Pat. No. 4,823,762.

BACKGROUND OF THE INVENTION

In the sport of archery, and in bow hunting, the archer often wants to be able to make one or more follow-up shots. The value of these shots depends, of course, on the speed and accuracy with which they can be made. Minimizing the action and attention required of the archer will tend to increase speed and accuracy. In hunting, it is also important that the follow-up shots involve a minimum disturbance of the environment, i.e., minimum noise and motion.

BRIEF SUMMARY OF THE INVENTION

My invention relates to a mechanized arrow holding and loading device for bows.

It is a major objective of my invention to provide a follow-up arrow holding and loading device that minimizes involvement of the archer and disturbance of the environment during the brief time before shooting.

The invention accomplishes this objective by means of a structure that holds a follow-up arrow in such a way that it needs to be moved sideways only an inch or so to be ready to shoot. This structure firmly holds the follow-up arrow in a position that is parallel to but transversely separated from the shooting position for an arrow, i.e., the position in which the arrow is longitudinally aligned with the bowstring and ready for nocking, drawing, aiming, and release by the archer.

In preferred embodiments involving automatic operation, the construction is such that shooting of the first arrow releases a carriage holding the follow-up arrow so that the carriage is moved transversely the required inch or so by energy stored in a spring. This movement carries the follow-up arrow into the shooting position. The arrow is firmly held on the carriage by a holding, stabilizing, and clamping mechanism until it is released from this mechanism by the archer when he or she is ready for shooting. Broadly, the invention may be embodied in a construction such that more than one follow-up arrow can be held on the carriage and the arrows moved successively into the shooting position. In this case, shooting of the first follow-up arrow releases the carriage to allow it to index transversely for an inch or so to bring the second follow-up arrow into shooting position. Likewise, shooting of the second follow-up arrow triggers action to bring the third follow-up arrow into position and so on. One form of the invention disclosed herein is adapted to hold two or more follow-up arrows and to extend through a unique window formed in the riser of the bow. A second form of the invention is of a simplified bolt-on construction that carries the follow-up arrow. A third form of the invention has a pivotal carriage that moves one follow-up arrow into shooting position along a transverse arcuate path.

The disclosed embodiments of the invention each has a frame with a flange that enables it to be rigidly bolted in place on various kinds of bows that are available on the open market. For a right-handed archer, the frame extends horizontally and to the left of the bow. The frame is adapted to support the first or initial arrow in a shooting position, ready to be shot by the archer. The carriage is constructed to carry one or more follow-up arrows and firmly support them in pre-shooting positions parallel to each other and to the first arrow. The carriage moves from left to right on the frame during unloading of the arrows and has an arrow holding, stabilizing, and clamping mechanism to firmly hold the follow-up arrow in the desired alignment, i.e., the pre-shooting position. This mechanism is preferably designed to release the follow-up arrow automatically when it is brought by the carriage into a position wherein the pre-shooting position coincides with the shooting position and the arrow is drawn to the rear by the archer. A retention means on the frame helps to prevent premature release of the mechanism before the follow-up arrow reaches the shooting position, i.e., while the arrow is in the pre-shooting position. Closing of the follow-up arrow holding mechanism stores energy in spring-like material that urges the mechanism to open but is prevented from doing so by a latch means and, as a back-up, by the retention means.

Movement of the carriage from right to left while loading it with one or more follow-up arrows stores energy in a spring means that urges the carriage to move in its direction of operation from left to right, i.e., in order to bring a follow-up arrow into shooting position. Such operative, left to right, movement of the carriage is prevented, however, by engagement of a stop face on the carriage with a movable stop and alignment member on the frame which is located to place the previous arrow in the shooting position. If there is more than one follow-up arrow, the frame also has a non-movable stop member which engages the stop face on the second follow-up station to hold the carriage on the frame. Preferably, the movable stop member on the frame is associated with an arrowrest for supporting the first arrow in the shooting position and in the first form of the invention it also supports any follow-up arrows that are moved from the pre-shooting position to the shooting position. In each form of the invention, when the arrow is shot, a radial projection on the arrow (such as fletching) rides over the arrowrest to move the movable stop member on the frame away from the stop face on the carriage. As soon as this occurs, the carriage is released and is automatically indexed to place the previously held station in the shooting position. A manually operated, override movable stop face is disclosed which the archer can use, if desired, as a lock device to prevent accidental release of the carriage. Preferably, resilient materials such as sponge rubber, cork, and "Velcro" are used at various places in the device to provide shock and sound absorption. In some locations they are also used to provide useful stored energy and/or to position parts or arrows.

As disclosed herein, the carriage has an arrow alignment wall and the arrow holder provides a resilient trough that holds the follow-up arrow against the wall. The wall and the holder have cooperating latch elements which form the latch means (referred to above) for releasably holding the arrow in place. The latch elements are disengaged to release the latch mechanism by a predetermined amount of rearward movement of the holder which will occur when the archer draws the follow-up arrow back preparatory to shooting it.

Also disclosed herein are means for mounting each of the three forms of the invention on "overdraw" attachments secured to the bow.

When an arrow is loaded on the carriage, it is preferable that it be angularly adjusted so that the bow string groove in the nock is in alignment with the bow string and plane of the bow. Thus, when it is fed into the shooting position, it is only necessary for the archer to draw it straight back to achieve nocking.

Other features, advantages, and objects of the invention will become apparent hereinafter.

DESCRIPTION OF THE DRAWINGS

The arrow holding and loading device of the invention (often referred to herein simply as the "loader") is shown on the drawings and described for use on a right-handed bow by right-handed archers. It should be understood that the device could be reversed and face the opposite direction and used on left-handed bows by left-handed archers.

DETAILED DESCRIPTION OF EMBODIMENTS OF THE INVENTION

FIGS. 1–13

Figure 1:
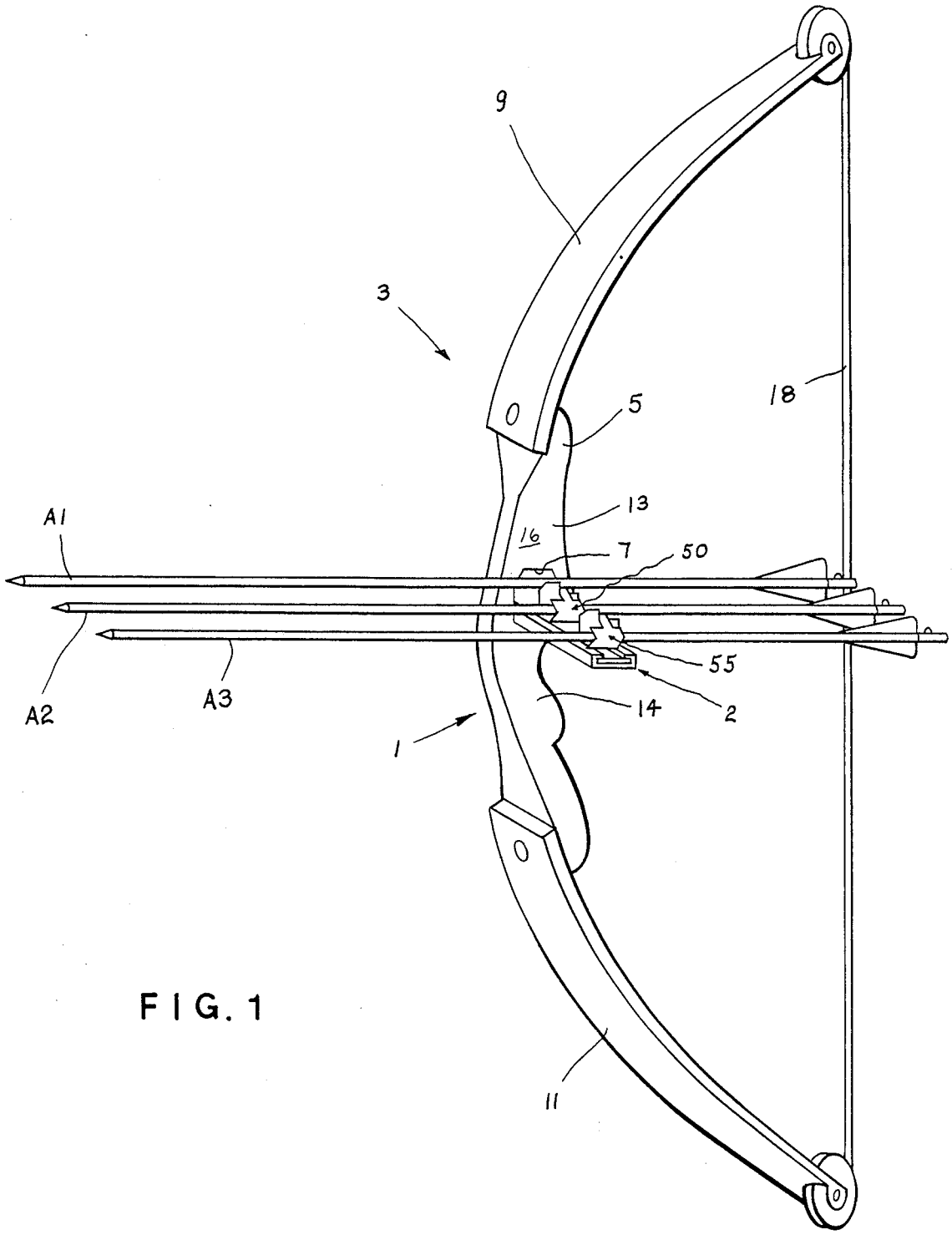
FIG. 1 is a perspective view of an archery bow having a modified riser with a loader according to the invention secured to it.

As seen in FIG. 1, an arrow holder and loader 1, according to the present invention, is shown mounted on a bow 3 which may be any of a wide variety of constructions. The bow 3 illustrated is to be used by a right handed archer and has a central riser section 5 to which are secured upper and lower resilient limb sections 9 and 11, respectively. A bow string 18 is attached by suitable means to the ends of the limb sections and has a nocking point (not shown in detail) that defines one end of a "center line" for the bow 3, the other end being defined by the point where a nocked arrow would be properly supported on the riser section 5 in proper shooting position to be shot by the archer. The "plane" of the bow may be regarded as the plane which contains this center line and the bow string 18.

The riser section 5 has a hand grip portion 14 (FIG. 1) adapted to be grasped by the left hand of the archer. The hand grip portion 14 is located on the left side (as seen by the archer) of the plane of the bow. Just above it and offset to the right of the portion 14 is an offset bow window portion 13 that includes a flat vertical wall (often called the "arrow plate") 16 that is substantially parallel to and located slightly to the right of the plane of the bow.

As will be observed from FIGS. 1–9, the arrow plate 16 of the bow handle riser 5 is not of the conventional type. The arrow plate section 16 has been modified so that the loader 1 can be integrated with the bow 3. In order to achieve integration or union, an opening 7 is provided in the arrow plate 16 which is basically rectangular in shape and extends from the left (arrow plate) side to the right side of the riser. Since it is desired to have an opening in the riser, the arrow plate is then divided by opening 7 and consists of a front wall section 8 and a rear wall section 6. To prevent the divided wall plate from cracking or breaking in half as a result of a released arrow, the walls, 6 and 8, are individually thick enough and wide enough so that their combined strength equals that of a conventional arrow plate section.

The bow 3 has a shelf on its handle which is conventional in the structure of bow handles. However, the shelf 4 of bow 3 has also been modified in structure so as to provide an adequate base for attaching the loader frame assembly 2 (best seen in FIGS. 2 and 3). The shelf 4 is wider (thicker) vertically and extends leftward farther than shelves on most bow handles.

This increased shelf size helps to prevent weakness in the divided arrow plate and provides enough base for paired threaded holes 21 (left or shelf side) and paired threaded holes 24 (right side of riser). The top flat surface 98 of shelf 4 is horizontal and at right angles to the arrow plate walls. Not only does the top surface 98 extend leftward but also extends rightward between the front wall 8 and the rear wall 6, thereby forming the bottom of opening 7.

Figure 8:
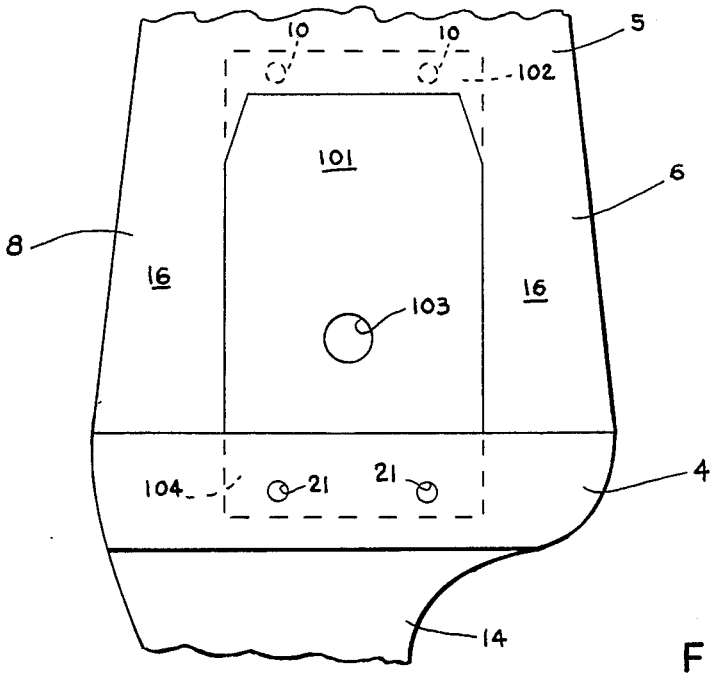
FIG. 8 is a side elevation of the modified bow handle riser (parts broken away) of FIGS. 1–7 with a plug in the opening so the bow can be used in the conventional manner.
Figure 9:
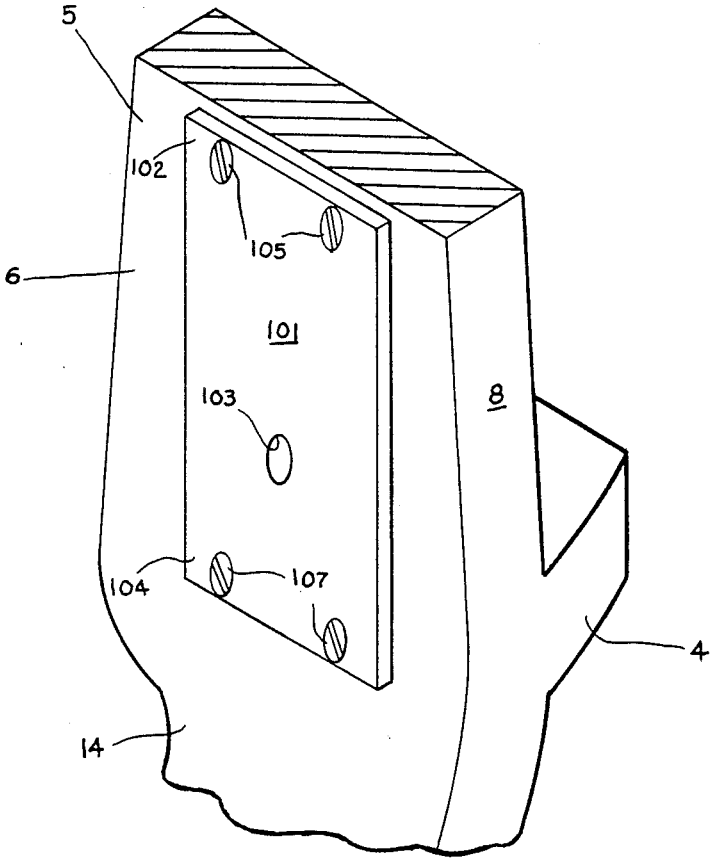
FIG. 9 is a perspective view of modified riser of FIG. 8 and the means by which the plug is attached.

An archer may not be financially able to buy the bow 3 and loader 1 at the same time. Therefore, an inexpensive hole plug 101 (possibly constructed of plastic) can be fitted into the arrow plate opening 7 so that bow 3 alone can be purchased and used in the conventional manner (FIGS. 8 and 9). The left side of plug 101 is a flat surface and is flush (assuming plug 101 is in hole 7) with rear wall 6 and front wall 8, and therefore the arrow plate of the bow 3 has a continuous arrow plate wall. The right side of plug 101 has an extended portion 102 at its top with countersunk holes that correspond to paired threaded holes 10 in the riser 5, and an extended portion 104 at its bottom with countersunk holes that correspond to paired threaded holes 24 in the riser. Screws 105 and 107 screw into holes 10 and 24, respectively, which hold the plug 101 securely in the opening 7. At a later time the archer could purchase the loader 1, remove the plug 101, and mount the loader 1 on the bow 3. If an archer wanted to return the bow 3 to conventional operation, he or she would remove the loader 1 and attach the plug 101.

Figure 2:
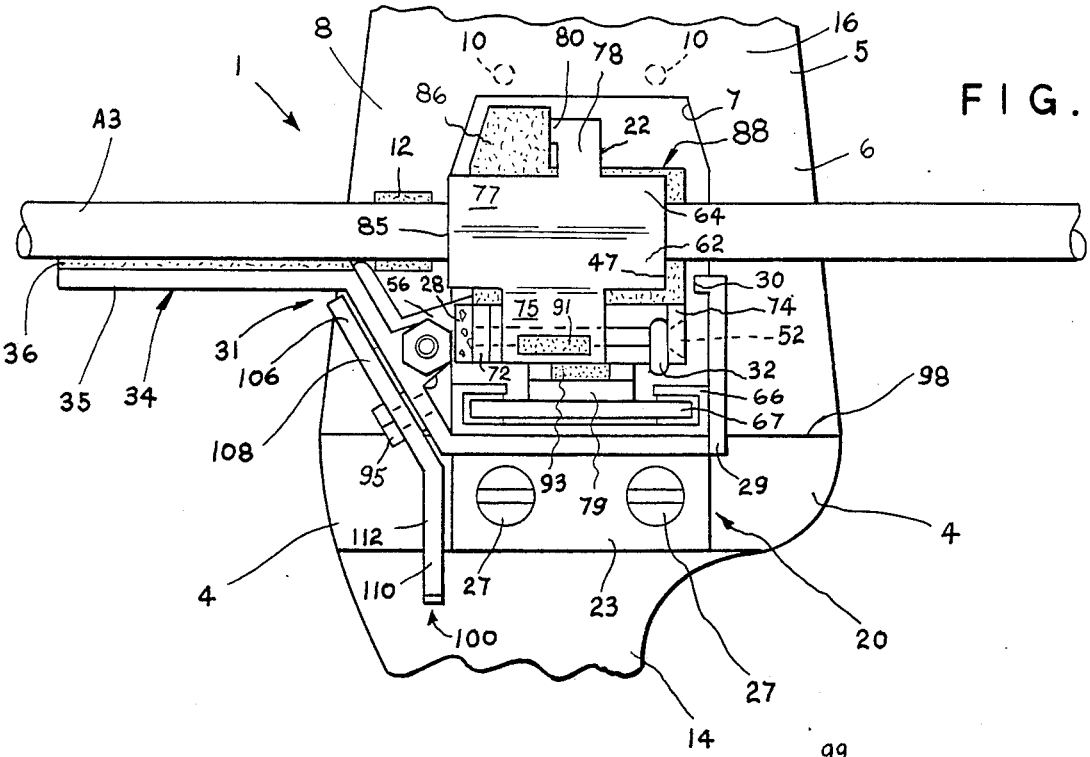
FIG. 2 is an enlarged side elevation of the loader mounted on and in the modified riser (portions of the bow handle shown broken away)
Figure 3:
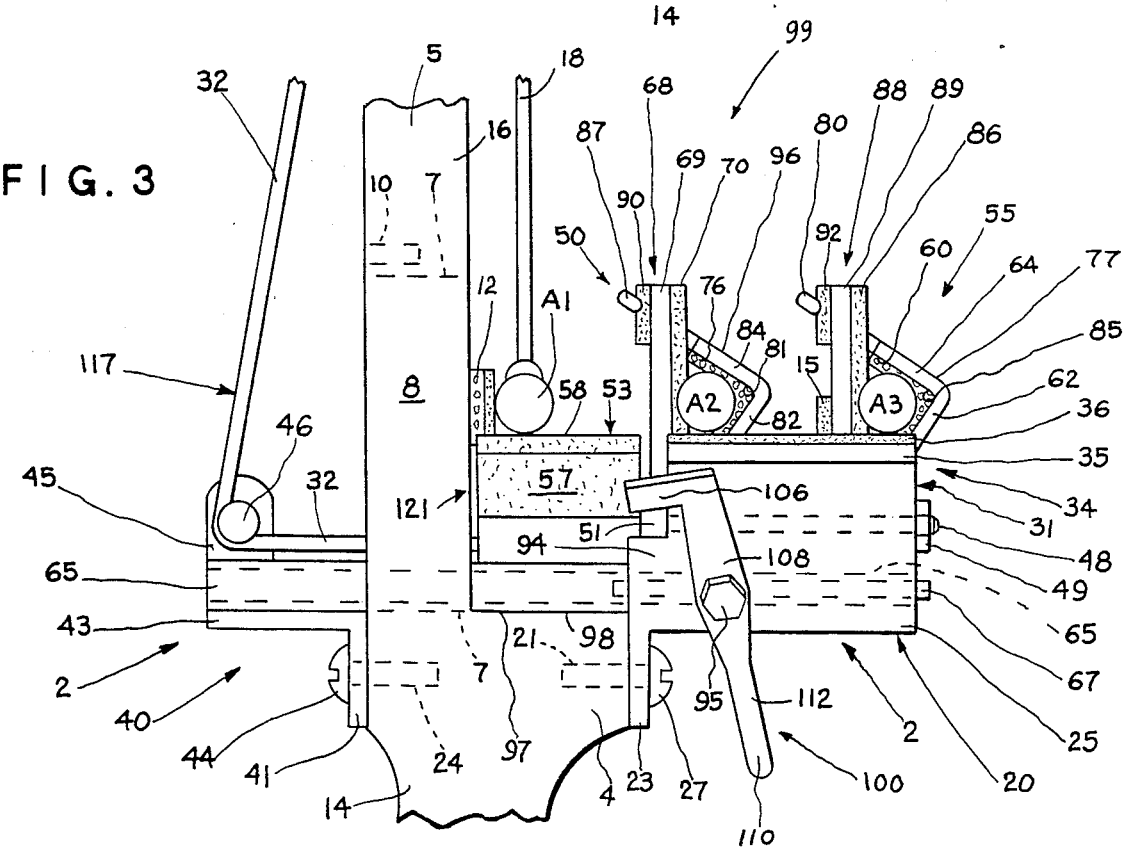
FIG. 3 is a front elevation of the loader and modified riser as shown in FIG. 2.
Figure 6:
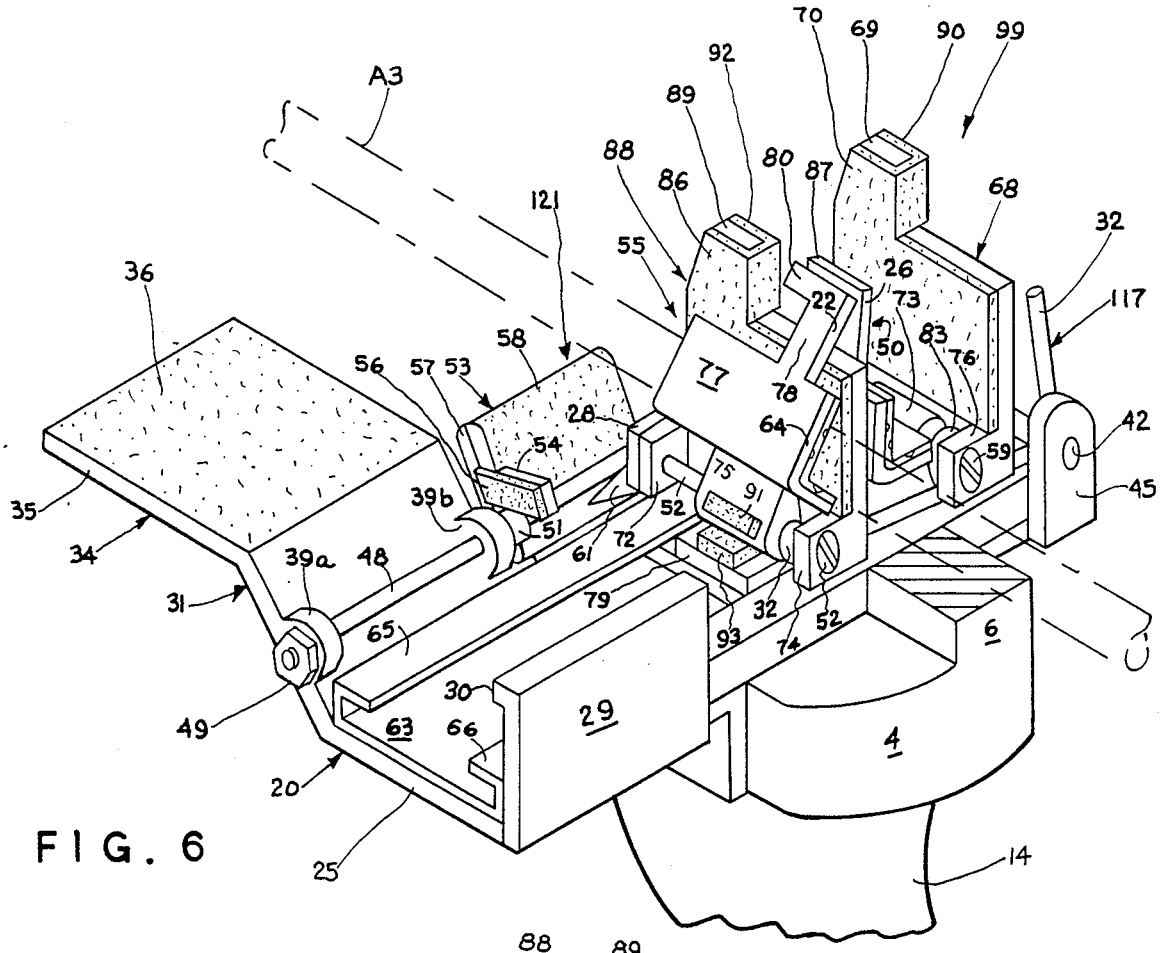
FIG. 6 is a perspective view showing the right portion of the loader's carriage having passed through the opening in the riser, and the operation of the arrow holder.
Figure 7:
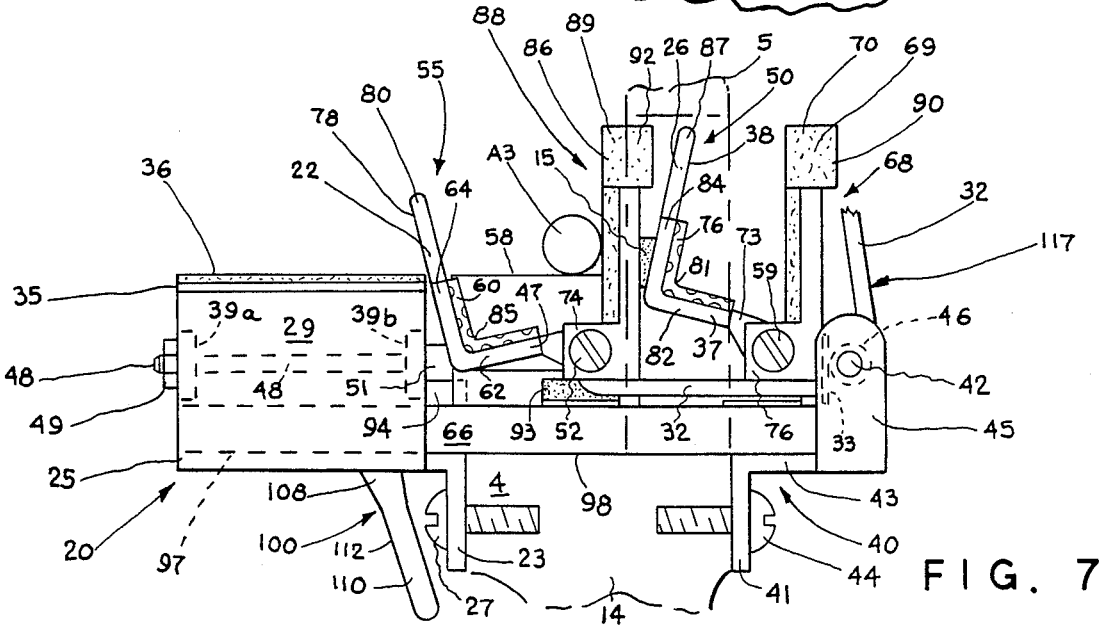
FIG. 7 is a back elevation again showing the right portion of the carriage in the opening of the riser and both arrow holders in the open position.

The arrow holder and loader 1 of the embodiment of FIGS. 1–13 has a loader frame assembly 2 which is secured to the bow handle shelf 4 and the riser 5 (FIGS. 2, 3, and 7). Frame portion 20 has a horizontal shelf 25 that is secured (by bolts or welding) to the bottom 97 of track means 63. Shelf 25 extends at right angles to provide flange section 23. It is firmly secured to the vertical side of the bow handle shelf 4 by screws 27 which pass through holes (not shown) in flange 23 and then screw into corresponding threaded holes 21. As shelf 25 extends past the front edge of track means 63, it angles upward to provide plate portion 31. At the top of plate 31, frame portion 20 again bends to provide a horizontal shelf 35 for supporting stored arrows (plate 31 and shelf 35 will be discussed later). Track means 63 is perpendicular to the plane of the bow and extends rightward through hole or opening 7. The horizontal bottom 97 of track means 63 is flat against the horizontal top 98 of bow handle shelf 4. Horizontal shelf 43 of frame portion 40 is attached (by bolts or welding) to the bottom 97 section that extends past the right side of the riser 5. Shelf 43 extends at right angles to provide flange 41 which is flat against the right side of riser 5. Screws 44 are inserted through holes (not shown) in the flange 41 and then screwed into corresponding threaded holes 24 which firmly hold flange 41 against the riser 5. Frame portion 40 extends at right angles to provide vertical flange 45 which is adjacent to and parallel to the vertical side of track rail 66. Flange 45 will be discussed in detail later. The bottom 97 of the track means (mid-portion) is flat against the top surface 98 of the bow shelf and vertical flanges 23 and 41 are firmly attached to the bow shelf and riser, respectively, therefore, the frame assembly 2 is held securely to the bow 3. In order to remove the frame assembly 2 from the bow, screws 27 and 44 would be removed; the frame assembly raised up until flange 41 is above surface 98; and then the frame assembly moved leftward and out of opening 7. The reverse operation would reattach the frame 2 on the bow 3.

A track means 63, part of the frame assembly, includes parallel rails 65 and 66 which extend at right angles to the plane of the bow and also extend through the opening 7 of the bow riser. As seen in FIG. 7 and from the archer's position, a major part of the track assembly is located on the left of the riser section 5. In the embodiment of the invention illustrated in FIGS. 1–13, the rails are opposite sides of a C-shaped channel.

An arrow carriage assembly 99 (to hold and load the arrows) is mounted on the track means 63 provided by the channel shaped rails 65 and 66 to move between a fully loaded position at the left ends of the rails (FIG. 3) and a fully unloaded position (not shown) at the right ends of the rails. The carriage assembly 99 includes a substantially flat plate-like traveler member 67 that fits in and slides in the channel rails 65 and 66. As seen best in FIG. 3 which shows a loader for three arrows (an initial or first arrow and two follow-up arrows), the member 67 carries two rigid vertical arrow alignment walls 68 and 88 that are parallel to the plane of the bow. Wall 68 is located at the right end of the member 67 (as seen by the archer) and wall 88 is located near the left end of the member 67. As will be subsequently recognized, spacer pad 12 defines a first arrow alignment station for an arrow A1 (which is on the center line of the bow or shooting position ready to be shot); the wall 68 defines a second arrow alignment station and pre-shooting position for the follow-up arrow A2; and, the wall 88 defines a third arrow alignment station and pre-shooting position for the follow-up arrow A3. Arrows A2 and A3 can be shot when moved by the carriage into the plane of the bow so that they are substantially coaxial with the center line of the bow, i.e., in the shooting position.

Wall 88 has a right angle foot or flange 79 (FIGS. 2 and 6) at the bottom which sits on top of plate 67 and is rigidly secured to it. On the left side of wall 88 near the bottom, but just above the rails 65 and 66, are two flanges. Vertical flanges 72 and 74 extend leftward from wall 88 at right angles and have aligned holes (not shown) to receive screw 52. The hole in flange 74 is non-threaded and counter sunk, whereas the hole in flange 72 is threaded. The screw 52 is threaded only on the portion that screws into flange 72. The shaft portion, up to the head, of flat-headed screw 52 is smooth. At the top of wall 88 is extended section 89. The left side of wall 88, and including section 89, is covered with a layer or face 86 of relatively soft, non-metallic, sound-deadening material (such as material identified as "Velcro" that is sold on the open market). The right side of the extended section 89 is covered with "Velcro" covering 92 which wraps around the back end of section 89 and adjoins "Velcro" layer 86. Wall 88 is identical in structure to wall 68, therefore, foot 79 corresponds to a right angled foot (not shown) on wall 68 which is also securely attached to plate 67; vertical flanges 74 and 72 of wall 88 correspond to vertical flanges 76 and 71, respectively, of wall 68; screw 52 of wall 88 corresponds to screw 59 of wall 68; "Velcro" facing 86 of wall 88 corresponds to "Velcro" facing 70 of wall 68; extended section 89 of wall 88 corresponds to extended section 69 of wall 68; and, "Velcro" covering 92 of wall 88 corresponds to "Velcro" covering 90 of wall 68 (for sound deadening and reduces friction).

FIGS. 1–7 show an arrow holder and loader 1 that supports three arrows (A1, A2 and A3), i.e., a three station mechanism. The first station, for the initial arrow A1, is represented by spacer pad 12 (rectangular sponge with "Velcro" facing); the second station, for the first follow-up arrow A2, is represented by wall 68; and the third station, for the second follow-up arrow A3, is represented by wall 88. Arrow A1 is on the center line of the bow and in shooting position. However, before follow-up arrows A2 and A3 can be released, they must be translated or moved transversely to the right (as seen by the archer) so that wall 68 is in alignment with the "Velcro" facing of spacer 12, then, following wall 68, wall 88 is in alignment with the "Velcro" facing of spacer 12. During this movement and during all the period that A2 and A3 are partially supported by walls 68 and 88, respectively, the archer is concerned with arrow A1 and his hands are not available to help hold arrows A2 and A3 in their proper position. Accordingly, the loader 1 includes an arrow holding, stabilizing, and clamping means for each station except the first (i.e., for each follow-up arrow) to firmly hold the follow-up arrows in proper position until they are ready to be grasped and pulled back by the archer.

As seen in FIGS. 3 and 5–7, holder and stabilizer members 50 and 55 are movably mounted near the bottom on walls 68 and 88, respectively, to pivot about a horizontal axis parallel to the plane of the bow. At the bottom of arrow holder 55 is journal portion 75 with a horizontal and longitudinal hole (not shown) that corresponds in diameter with the holes in flanges 72 and 74. Just above the journal portion is horizontal clamp 77 that has a top plate 64 and a bottom plate 62 which are angled to form a V-shaped horizontal trough 85. The inside of clamp 77, i.e., the trough 85, has cork lining 60 for better gripping capability. Clamp plate 64 extends upward on the same plane and provides riser section 78. Still on the same plane and extending forward from the riser 78 is portion 80. Screw 52 is inserted in the hole of vertical flange 74, pushed through the hole in the journal portion 75, then screwed into the threaded hole in the flange 72. Thus, arrow holder 55 is movably secured between flanges 72 and 74. Since the shaft portion of screw 52 between flanges 72 and 74 is smooth (non-threaded), the arrow holder 55 can easily slide back and forth or pivot right or left. Arrow holder 55 is identical in structure to arrow holder 50, therefore, journal 75 corresponds to journal 73; clamp 77 corresponds to clamp 96; cork lining 60 corresponds to cork lining 76; riser 78 corresponds to riser 38; and extended portion 80 corresponds to extended portion 87, respectively. Screw 59 is pushed through the hole in vertical flanges 76, through journal 73, and then screwed into the threaded hole in vertical flange 71. Like arrow holder 55, the arrow holder 50 is now able to slide back and forth or pivot right or left on a smooth shaft between vertical flanges.

Figure 5:
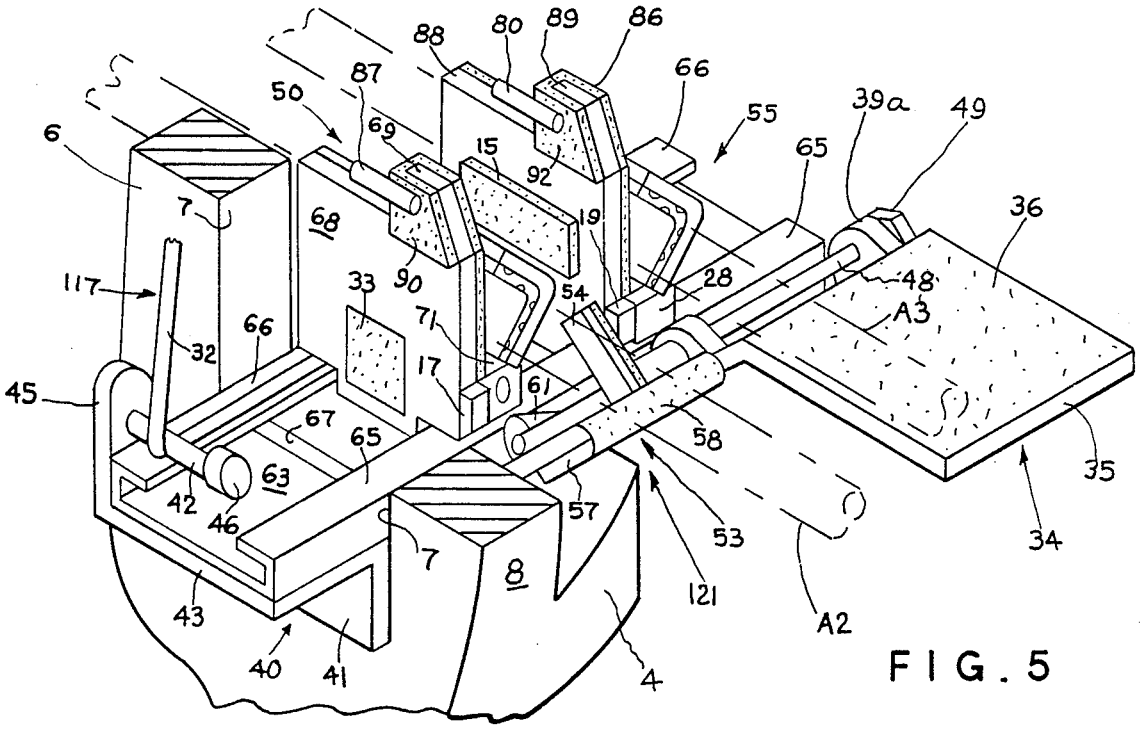
FIG. 5 is the same view as FIG. 4, except the rightward movement of the carriage (as seen by the archer) has been stopped by the stop and positioning mechanism.

Before arrow A3 can be placed in the stored pre-shooting position, arrow A3 must be held securely by the arrow holder 55. First, wall 88 must be in alignment with the shooting position (FIG. 7). Arrow A3 is placed horizontally against the "Velcro" facing 86 on the left side of wall 88 and arrow holder 55 is manually pivoted rightward so that a portion of the shaft of arrow A3 is in horizontal trough 85 (FIG. 6). Cork lining 60 and "Velcro" layer 86 are springable or resilient materials. Therefore, as the archer continues pushing rightward on the arrow holder 55, cork lining 60 and "Velcro" layer 86 are elastically compressed between clamp 77, arrow A3, and wall 88, respectively. At this point, portion or latch arm 80 is far enough to the right so it has clearance to go behind extended section or latch wall 89. With the rightward pressure still applied, the archer pushed forward against the end portion 22 of riser 78 and the arrow holder 55 slides forward on the smooth shaft of screw 52 about ¼ inch. Since the latch arm 80 is an integral part of the arrow holder 55, the latch arm 80 also moved forward about ¼ inch, thereby, going behind (to the right of) "Velcro" facing 92 and latch wall 89. Arrow A3 is gripped tightly on its left side by the cork lining but is against the smooth "Velcro" face on its right which is easy to slide against, therefore, arrow A3 was also pulled forward the ¼ inch or so. Arrow holder 55 is now latched in the clamping and holding position around arrow A3 as seen in FIGS. 2, 3 and 5. At this point the carriage assembly 99 is manually pushed leftward in the track means 63 until wall 68 is in alignment with the shooting position. Arrow A2 is loaded the same way as arrow A3. When arrow holder 50 is clamped around arrow A2 and latch arm 87 is behind latch wall 69, then the carriage assembly 99 is again pushed leftward until arrows A3 and A2 are in the stored position. Now arrow A1 can be placed in the shooting position. Thus, arrow holders 50 and 55 act as stabilizers for follow-up arrows A2 and A3, respectively, to firmly maintain them in a desired pre-shooting position of alignment and parallel to arrow A1 and the shooting position.

In order for arrows A2 and A3 to be released, the holders must slidably move back about ¼ inch so their latch arms will no longer be behind the latch walls. However, when the carriage 99 is at the far left of track means 63 with arrows A2 and A3 in stored position, retention wall 29 serves as a barrier that holds the latch arms behind the latch walls should the normal clamp force between the follow-up arrows and the clamp members 50 and 55 be accidentally reduced or lost. As best seen in FIGS. 2, 6, and 7, vertical retention wall 29 is located at the left end of track means 63 and is rigidly attached to the vertical side of rail 66. Wall 29 extends at right angles to provide a short horizontal flange that protrudes forward and the vertical end of the flange serves as stop face 30. If arrows A2 and A3 were pushed back while in the clamped and stored position, the arrow holders would also be pushed back because of their tight grip on arrows A2 and A3. The latch arms need at least about ¼ inch backward movement in order to disengage the latch walls. However, the end portions 37 and 47 of arrow holders 50 and 55, respectively, engage stop face 30 after moving back only about ⅛ inch. This limited backward movement prevents the latch arms from disengaging the latch walls. Since a portion of the latch arms are behind the latch walls, the arrow holders are still clamped tightly around arrows A2 and A3. At this point an archer needs only to push forward on the riser end portions 26 and 22 of the arrow holders 50 and 55, respectively, to again have the latch arms fully behind the latch walls. If arrows A2 and A3 are to be loaded or unloaded, they must be in the shooting position so the arrow holders will be clear of the retention wall (FIGS. 6 and 7).

When an arrow is drawn and released, a vibration results in the string, bow, and attachments on the bow. Therefore, the loader 1 has an arrow support means 34 which extends past the front of the loader and helps stabilize stored arrows A2 and A3. Support means 34 provides horizontal shelf 35, which extends from the top section of angled plate or bracket 31, and is covered with "Velcro" facing 36 for sound-deadening. When either or both follow-up arrows are in the stored position, their front shaft portions rest on "Velcro" 36 of shelf 35. "Velcro" facing 36 is on the same horizontal plane as the bottom of the shafts of arrows A1 and A2. When plate 53 (to be described) is in the uppermost position, its top or arrowrest 58 will also be on the same horizontal plane as the "Velcro" facing 36 (best seen in FIG. 3). Therefore, as the stored arrows are moved transversely to the right, there is a smooth transition from shelf 35 to arrowrest 58.

A spring motor means 117 is used to move the carriage 99 to the right in the track means 63. The spring means stores energy when the carriage is manually moved to the left to the loaded position. As illustrated, the spring motor means 117 is preferably in the form of an elastic cord 32 of one or more strands which is stretched between a fixed anchor on the bow riser (or other non-movable part such as the frame assembly) and an anchor on the carriage 99 and is long enough to supply the required energy at the required rate. The fixed anchor (not shown) is on the right side of the riser 5 and above the opening 7 while the screw 52 can conveniently be used as the carriage anchor (FIGS. 2 and 6). Screw 42 is smooth shafted except for its end portion that screws into vertical flange 45 and is also horizontal and parallel to the plane of the bow. One end of the elastic cord 32 is secured to screw 52, extends horizontally and rightward between the bottoms of plates 88 and 68 and the top of rail 66, is trained under and around the smooth shaft of screw 42 so that its direction is changed to near vertical and then anchored to the right side of the riser (FIGS. 2–7). The elastic cord is stretched as the carriage 99 moves to the left, away from the smooth shaft 42.

Figure 4:
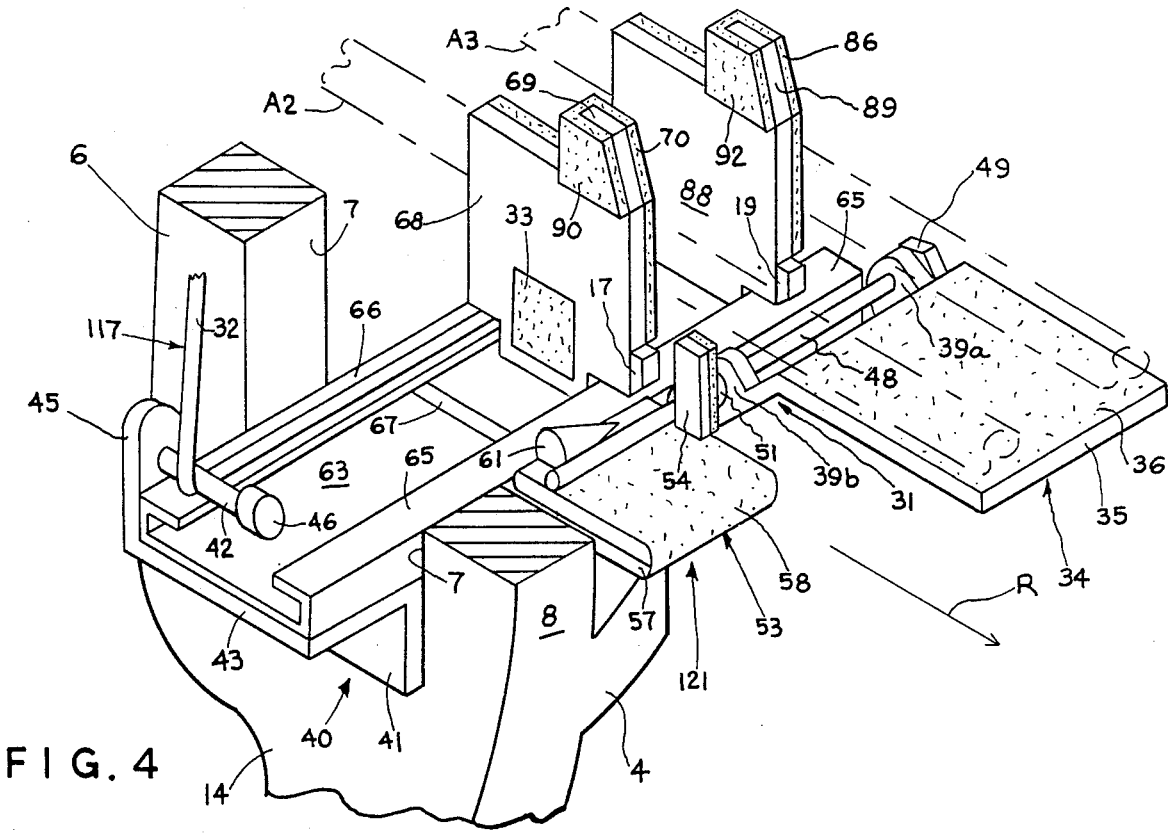
FIG. 4 is a perspective view of the loader (parts omitted for clarity) and a modified riser (portions of the riser and grip are cut and broken away), and especially showing the stop and positioning mechanism an instant after it has released the carriage for indexing.

A stop and positioning means 121 is provided to control and properly align the transverse positions of the carriage 99 on the track means 63, i.e., with respect to the plane of the bow so that initial and follow-up arrows are positioned in the shooting position with their centerlines coaxial with the centerline of the bow. The stop and positioning means 121 includes the angled plate 31 (extended portion of shelf 25) which extends at right angles to provide flanges 39*a* and 39*b* with corresponding horizontal holes (FIGS. 4–6). Rod or shaft 48 extends through the holes in flange 39*a* and flange 39*b* of plate 31 and is at right angles to the plane of the bow.

Attached to the right end portion of shaft 48 is plate 53 and its top and bottom ends are horizontal and are at right angles to the plane of the bow (FIGS. 4–6). Plate 53 is movably mounted since it is attached to shaft 48 which turns in the holes of flanges 39*a* and 39*b*. Plate 53 has a section above and below the attached shaft 48. The upper left section extends at right angles to provide arm 54 which has on its left side stop face 56 and, if desired, can be covered with "Velcro" facing for sound-deadening. Spacer sleeve 51, which is on shaft 48, separates plate 53 from plate section 31 and also keeps arm 54 in the desired alignment for engaging vertical walls 68 and 88. Retention nut 49 which is screwed onto the threaded end of shaft 48 keeps shaft 48 and attached plate 53 movably secured in flanges 39*a* and 39*b*. The lower portion of angled plate 31 extends rightward as seen by the archer and provides rectangular section 94 (FIGS. 3 and 7). When plate 53 pivots forward it is stopped in a near horizontal position when the front of plate 53 abuts against the top of section 94 (FIG. 4). The upward pivotal movement of plate 53 is stopped when the lower left front portion of plate 53 engages the back side of section 94 (FIG. 7). Therefore, section 94 controls the forward and backward pivotal movement of plate 53. When plate 53 is in the upper most "up" position, its top end or arrowrest 58 will be on the same horizontal plane as the top surface 36 of arrow support shelf 35.

When carriage 99 is pushed to the left so that arrows A2 and A3 are in the stored position, plate 53 can be manually pivoted to the "up" position. Arm 54 and its stop face 56 will also be in the "up" and operative position since they are an integral part of plate 53. At this point, the archer releases leftward pressure on the carriage 99 and it is urged back to the right by the stretched elastic cord 32. However, the rightward movement of carriage 99 is stopped when stop face 56 (in the "up" position) engages the back of vertical plate 68 (FIGS. 2 and 3). The archer releases his hold on plate 53 and it remains in the up position since vertical plate 68 is tight against arm 54. Arrow A1 can now be loaded, i.e., the nock of A1 can be nocked on the string 18 and its shaft positioned on the top end 58 (arrowrest) of plate 53.

The portion of plate 53 that is below shaft 48 (facing the archer) provides a surface for the attachment of a structure that is similar in shape to one-half of a cone. The point of the half cone points left while the enlarged end faces right. This half cone structure functions as cam 61 which helps to return plate 53 to the up position. The small extensions 17 and 19 (FIGS. 4 and 5) which are attached to the front ends at the bottom of plates 68 and 88, respectively, are in line with cam 61 when the plate 53 is in the "down" position. The bottoms of cam-engagers 17 and 19 are angled and their edges rounded slightly for smooth engagement of cam 61. A "Velcro" facing may be adhered to the cam-engagers, if desired, for sound-deadening. When plate 53 is in the up position cam 61 is not in alignment with the cam-engagers.

Assuming arrows A2 and A3 are in the storage position and plate 53 is in the up position to block the rightward movement of carriage 99, then the archer loads arrow A1 (FIG. 3). He or she draws arrow A1 and releases. Arrow R indicates the release of arrow A1 (FIG. 4) and plate 53 has been pivoted forward and down to a near horizontal position as the bottom fletching of arrow A1 passed over. At this point, cam 61 is in alignment with cam-engager 17. Also, arm 54 with its stop face 56 is no longer blocking carriage 99 and the carriage is immediately pulled rightward by the stretched elastic cord 32. FIG. 5 shows the loader a moment later. As the carriage moved rightward, cam-engager 17 pushed against cam 61 starting at the left or small end of the cam and continuing until the large end had been pushed and passed by. By the time the large end of cam 61 was pushed away (forward) the plate 53 had pivoted to the "up" position so that stop face 56 of arm 54 engaged the back of vertical plate 88 of the carriage. Plate 53 is prevented from falling forward because of the rightward pressure against it by plate 88. Arrow A2 has now assumed the position (i.e., the shooting position) previously held by arrow A1 and, if using a modified nock (described in my copending U.S. application Ser. No. 076,798), arrow A2 has engaged the bow string 18 from the side.

The archer reaches up and grasps the nock of arrow A2. In one continuous backward pulling motion, arrow A2 is nocked on string 18 and is pulled to a full draw. At the same time, arrow holder 50 was slidably moved back on screw shaft 59 because of the grip of cork-lining 76 in trough 81. Washer 83 (FIG. 6), which is of a "Velcro" material, is adhered to the inside vertical face of flange 76 and prevents journal 73 from directly butting against flange 76 (i.e., washer 83 has a sound-deadening function). When latch arm 87 cleared latch wall 69, arrow holder 50, which was under springable pressure from cork lining 76 and "Velcro" facing 70, automatically pivoted leftward on screw shaft 59. The leftward movement of arrow holder 50 was stopped when clamp 96 of arrow holder 50 abutted against "Velcro" pad 15 on the back of vertical plate 88 (FIGS. 5 and 7). The shaft of arrow A2, no longer held by arrow holder 50, is now supported by arrow rest 58 which is in the up position and on the same plane as surface 36. It can be seen in FIG. 4 that cam 61 is spaced back from the right end of plate 53 (as seen by the archer) so that when released arrow A2 pushes arrow rest plate 53 down, the cam 61 will not pivot into cam-engager 17. At this stage of operation it would not be desirable for cam 61 to engage the cam-engager since this would limit the forward pivoting range of plate 53 and the carriage 99 would not index smoothly.

Assuming arrow A2 is fully drawn, the archer releases and plate 53 is pivoted forward and down as arrow A2's bottom vane passes over arrow rest 58. Arm 54 of plate 53 is no longer blocking carriage 99 and stretched cord 32 again indexes the carriage rightward during which time cam-engager 19 of vertical plate 88 pushes against the cam 61 thereby pivoting plate 53 to the up position (FIG. 6). Plate 53 must remain in the up position in order to support arrow A3 when A3 is released from arrow holder 55. After the last vertical plate has moved into the shooting position (in this case plate 88), arm 54 has nothing to engage that will keep it and plate 53 in the up position. Sponge 28 (FIGS. 2, 5, and 6) is attached to the front side of vertical flange 72 and the front vertical surface of sponge 28 is on the same vertical plane as the front vertical surface of cam-engager 19. The right end of sponge 28 is tight against the left end of cam-engager 19 and therefore provides a continuous front surface of cam-engager 19 and sponge 28. In its rightward movement, cam-engager 19 pushed cam 61 pivotally forward and passed by cam 61. However, cam 61 engaged sponge 28 immediately after disengaging cam-engager 19 which kept cam 61 pushed forward. Therefore, plate 53 with arrow rest 58 remained in the up and operative position.

An alternate set-up would be to eliminate cam-engager 19 and sponge 28 and have an arrow rest attached to the last station as do other embodiments of my invention, e.g., short track (FIGS. 14–20) and pivot (FIGS. 21–35) types.

For compactness the carriage 99 does not provide a vertical plate at the far left of sliding plate 67 that will engage arm 54 for the subsequent positioning of the last station (in this case station 3). Instead, screw 42 which is screwed into a threaded hole (not shown) in vertical flange 45, provides a stop and positioning means for the last station and also prevents the carriage from being pulled out of the track means (FIGS. 4–7). As previously mentioned, screw 42 is on a horizontal plane and parallel to the plane of the bow. After arrow A2 is shot, carriage 99 moves rightward in the track means 63 until "Velcro" pad 33 (for sound-deadening) on the back of vertical plate 68 engages head 46 of screw 42. At this point, arrow A3 is in the shooting position ready to be drawn and released. Also, a major portion of carriage 99 has passed through the opening 7 in the bow riser 5. It should be understood that the length of the loader could be extended to carry more follow-up arrows, i.e., the track means 63 would extend farther to the left and right of riser 5; arrow support shelf 35 and retention wall 29 would extend farther to the left; and the sliding plate 67 would be longer and provide more vertical plates for stations. If, for example, the loader is extended enough to carry four follow-up arrows, the screw 42 would be far enough to the right on the lengthened track means to engage the back of the vertical plate of station 2 so that the last station (station 5 of follow-up arrow 4) would be in the shooting position.

Now that arrow A3 is in the shooting position, the archer grasps the nock end of arrow A3 and pulls straight back. Like arrow holder 50, arrow holder 55 is slidably pulled back as arrow A3 is pulled back because of the grip of cork lining 60 in trough 85. When latch arm 80 is back far enough to clear latch wall 89, arrow holder 55 which is under pressure will automatically pivot leftward on the smooth shaft of screw 52 and at the same time release its hold on arrow A3. Elastic cord 32, which is looped around screw 52, prevents journal portion 75 from contacting flange 74 which further prevents unwanted noise. As arrow holder 55 pivots leftward, sponge portion 91, which is adhered to journal 75, engages sponge portion 93, which is adhered to foot section 79. As sponge 91 engaged sponge 93, the arrow holder 55 was slowed and stopped before pivoting far enough to the left to contact track 66 which, if allowed, would cause unwanted noise. Arrow A3 has been fully drawn and the front portion of its shaft is resting on arrow rest 58 of plate 53 which is in the up position. Arrow A3 is released and its bottom fletching rides over and pushes down on plate 53. At the same time, cam 61 is pivoted up into sponge 28 but is then pushed back when there is no longer downward pressure from the bottom vane of arrow A2 on plate 53. Thus, sponge 28 not only helps hold plate 53 in the up and operable position, but also allows plate 53 to depress as arrow A3 rides over. Even though plate 53, at this point, is not disengaging a vertical plate for the release of the carriage, it is preferable that plate 53 still pivot down so that the fletching of A2 (as it rides over) does not engage a rigid arrowrest which could adversely affect its desired flight path.

After arrows A1, A2, and A3 have been shot (or unloaded), the loader can be reloaded starting with station 3, i.e., in reverse order. Arrow A3 is clamped in place and the carriage is pulled leftward. As cam 61 disengages sponge 28 and cam-engager 19, plate 53 falls or pivots forward because of gravitational pull since nothing is tight against it. The archer manually raises plate 53 to the up position and releases leftward pressure on carriage 99 so vertical plate 88 is pulled rightward against arm 54 of plate 53. Arrow A2 is then clamped in place and the carriage pushed leftward which again causes the plate 53 to fall forward. Plate 53 is manually raised to its up position. The archer releases leftward pressure on the carriage so vertical plate 68 is pulled rightward against arm 54. Arrow A1 can now be loaded. It should be noted that arrows of various shaft diameters can be used with the loader. Flat plate shims of various thickness may be placed between the cork lining and the top and bottom plates of each clamp so the troughs can apply the proper amount of "grip" on the arrows being used by the archer.

An archer may decide to walk around and at the same time carry the bow 3 with the loader 1 fully or partially loaded. As the archer moves around there is the possibility, especially if hunting, that the arrow in the shooting position could bounce or move enough so as to pivot plate 53 downward. If plate 53 is pushed down only slightly, this could cause the released arrow to shoot lower than desired. However, if plate 53 is pushed far enough down, arm 54 would release the carriage which would then be pulled rightward in the tracks and the arrow in the shooting position would be caught between a vertical plate on the carriage and the divided riser walls. The arrow in the shooting position would not be able to be shot at that instant and would have to be reloaded. Locking means 100, when placed in the operative position by the archer, will prevent an unwanted carriage release. Locking means 100 provides a lever 112 which is movably mounted on the lower front of bracket or plate 31 (FIGS. 2, 3, and 7). Bolt 95 passes through a hole (not shown) in the mid-portion 108 of lever 112 and screws into a threaded hole (not shown) in bracket 31. Bolt 95 is threaded only on its end portion that screws into bracket 31; therefore, lever 112 pivots on the unthreaded or smooth section of the shaft of bolt 95. Washer 115 separates lever 112 from the front flat surface of bracket 31. The lever's lower portion 110 can be finger actuated and thereby be moved to a locked or unlocked position. Lever 112 is conveniently located so that the archer's left forefinger (assuming the archer is using a right-handed bow) can easily push the lever's handle 110 right or left while carrying or holding bow 3 in the shooting position. If handle 110 is pushed to the right, rightward extended portion 106 which is at the top of lever 112 is pivoted leftward and is not blocking plate 53. However, when the handle is pushed to the left, section 106 is pivoted rightward and is blocking the forward movement of plate 53. Plate 57 is attached to the front surface and near the top of pivoting plate 53. Therefore, plate 53, when in the up position, has a front surface that is flush or on the same plane as the back surface of section 106. When locking means 100 is in the operative position, i.e., when stop member 106 is engaging stop face 57, the archer does not have to continually look to see if plate 53 is in the proper position.

FIGS. 10–13—Rear Mounted Loader

Figure 10:
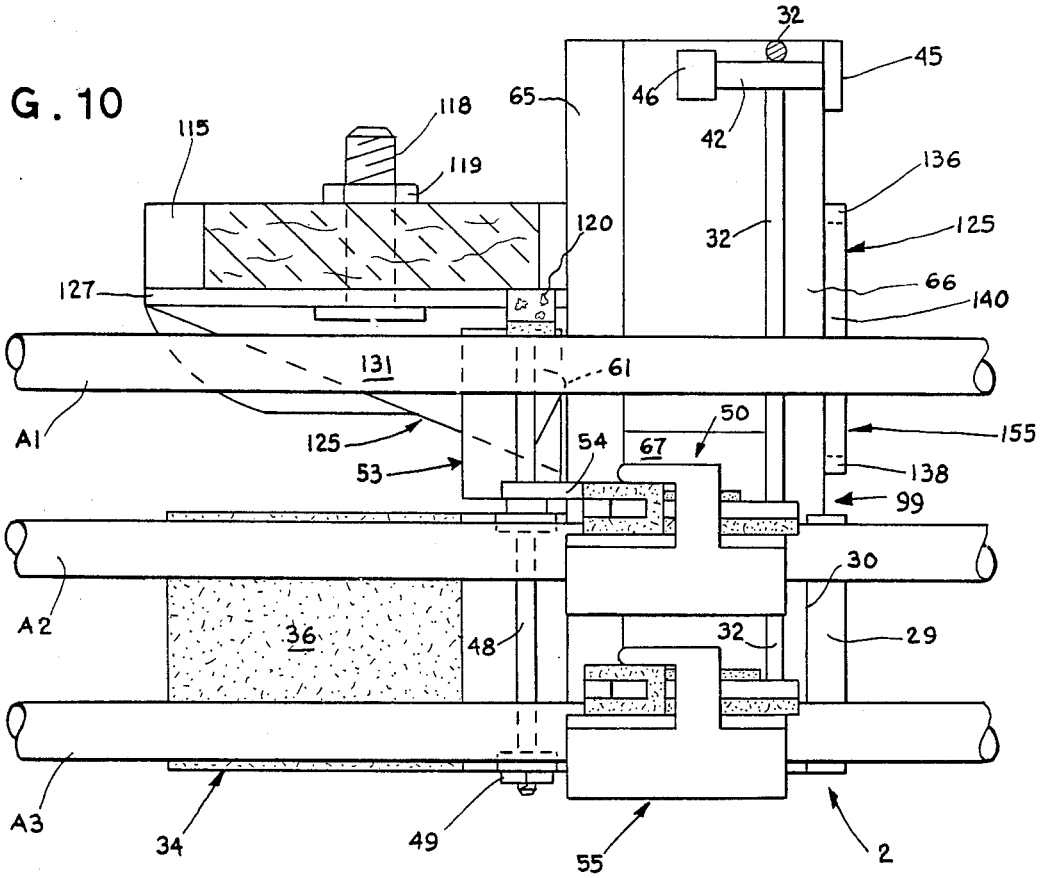
FIG. 10 is a top plan view (with conventional bow in section) of the arrow loader of FIGS. 1–7 mounted on a frame so the loader can be mounted to the rear of the conventional riser.
Figure 11:
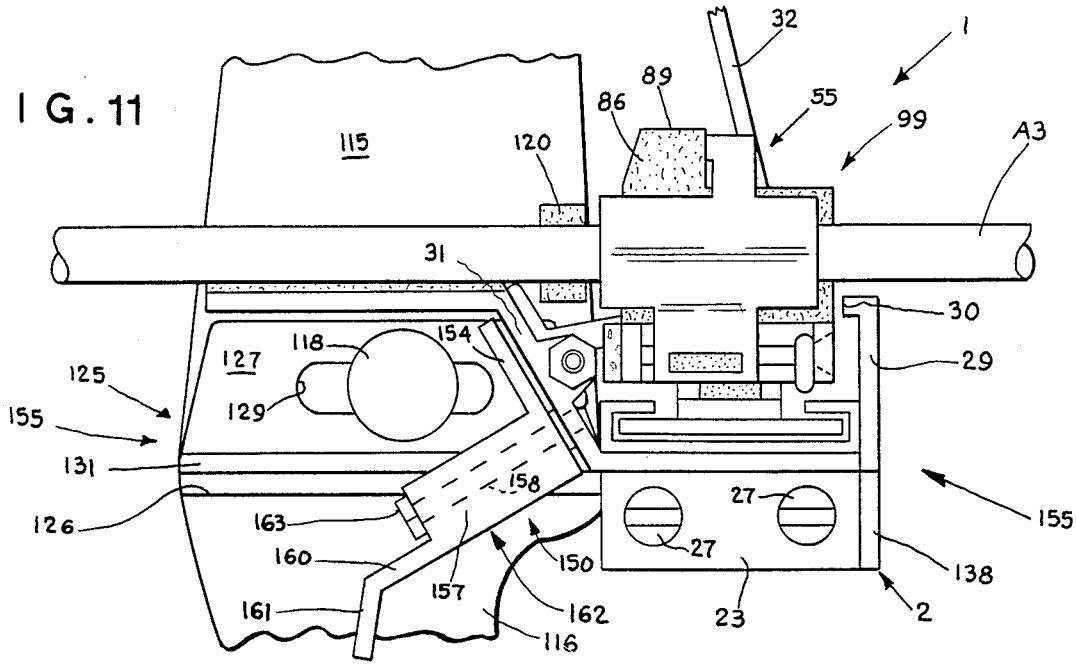
FIG. 11 is a side elevation from the left of FIG. 10 of the loader.
Figure 12:
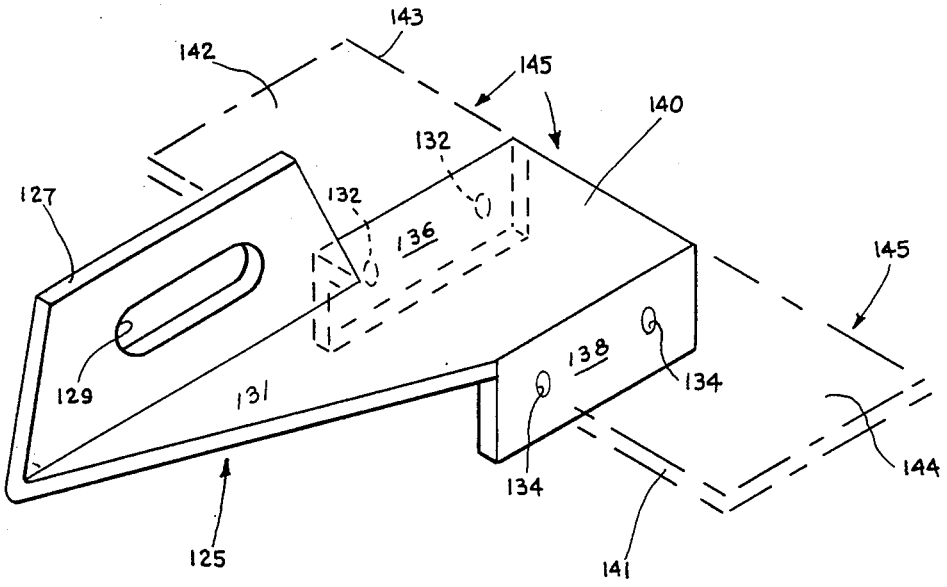
FIG. 12 is a perspective view of a frame that the loader of FIGS. 10–11 can be mounted on so that the loader can be attached to a conventional bow riser and to the rear of the riser.

As best seen in FIG. 12 frame 125 has a vertical flange section 127 and in its mid-portion has hole 129 through which carriage bolt 118 can be inserted. Hole 129 is elongated which allows for positioning and adjustment on various kinds of bows. Extending from flange 127 to the left at right angles is horizontal section 131 which is triangularly shaped. Section 131 extends back to provide shelf section 140. On the left side (as seen by the archer), shelf 140 extends downward at right angles to provide vertical flange 138 which has holes 134. On the right side shelf 140 extends downward at right angles thereby providing flange 136 which has holes 132. The distance from the inside face of attachment flange 23 to the inside face of attachment flange 41 (FIG. 3) allows frame assembly 2 to be placed upon shelf portion 140 so that the outside vertical faces of flanges 138 and 136 fit with close tolerance between flanges 23 and 41 respectively. Holes 134 are in alignment with holes 21 and holes 132 are in alignment with holes 24. When frame assembly 2 is placed upon shelf 140 of frame 125, the bottom mid-section 97 of frame assembly 2 will be in solid contact with the top of shelf 140 and flanges 23 and 41 will straddle shelf 140 and will be against flanges 138 and 136 respectively. Bolts 27 are inserted from the left to the right through holes (not shown) in flange 23 and aligned holes 134 and retention nuts (not shown) are screwed on the threaded ends of bolts 27 thereby firmly securing flange 138 to flange 23. Bolts 44 are inserted from right to left through holes (not shown) in flange 41 and aligned holes 132 and retention nuts (not shown) are screwed on the threaded ends of bolts 44 thereby firmly securing flange 136 to flange 41. At this point, frame 125 and frame assembly 2 are firmly together and comprise frame assembly 155 which can be bolted to a conventional bow handle riser 115 by carriage bolt 118 and nut 119 as seen in FIGS. 10 and 11.

Since flange 127 and frame shelf 131 are located to the front of frame assembly 2, the track means 63 (an integral part of frame assembly 2) is located behind conventional riser 115. Flange 127 is parallel to the plane of the bow while the track means 63 is at right angles to the plane of the bow. Assuming frame assembly 155 is attached to the riser 115 by bolt 118 and nut 119, carriage assembly 99 can be mounted on the track means 63 and fully loaded as shown in FIGS. 10 and 11.

Figure 13:
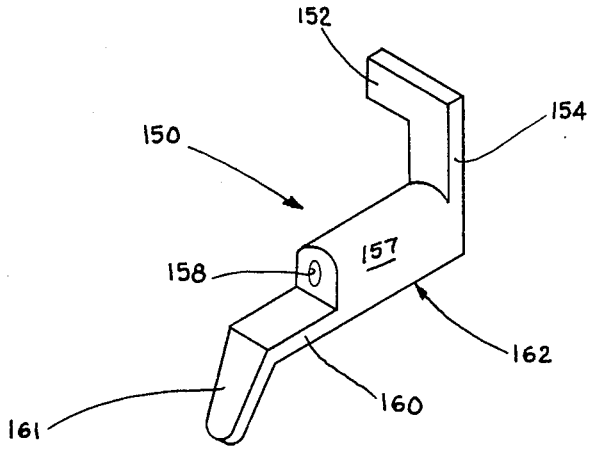
FIG. 13 is a perspective view of a locking mechanism that can be used on the loader of FIGS. 10–11 when the loader is mounted to the rear of the conventional riser.

Because the loader 1 is now mounted on a conventional riser and to the rear of the riser, a few adjustments and modifications are necessary. Elastic cord 32 angles forward after being trained around shaft 42 so it can, as previously, be anchored to the upper right portion of the bow handle riser. Conventional riser 115 (FIG. 10) is narrower from the left side to the right side than the modified riser (FIG. 3); therefore, spacer and guide pad 120 (which is "Velcro"-faced and adhered to the left side of riser 115) for arrow A1 extends farther to the left from riser 115 than does spacer pad 12 from riser 5. So that the archer will still be able to activate the locking means with the forefinger, bolt 95 and lever 112 have been replaced with bolt 163 and lever assembly 162. Therefore, locking means 100 corresponds in function to locking means 150. As best seen in FIG. 13, lever assembly 162 is comprised of a flat plate 160 which extends at right angles to provide riser section 154. Extending to the right from riser 154 as seen by the archer, is portion 152 which functions as a stop member in the same manner as portion 106 (FIG. 3) which, when placed in the path of plate 53 would prevent plate 53's forward pivoting movement. At the front of plate 160 is extended portion 161 which angles downward and provides a handle that corresponds to handle 110 of lever 112 which can be finger actuated to move the locking means between an operative and inoperative position. Journal 157 is mounted on top of plate 160 (as by welding) and its back face surface is against vertical riser 154. Hole 158 runs longitudinally through the center of journal 157 and continues through riser section 154. Bolt 163 has a smooth shaft except for the threaded end and is of the same diameter and thread size as bolt 95; thus, it will screw into the same hole in bracket 31. The bolt 163 can be inserted through hole 158 and then screwed into the hole (not shown) near the bottom of bracket plate 31. A washer or washers may be used between the front surface of bracket 31 and the back surface of riser 154 so as to achieve the desired tightness or looseness of lever assembly 162. Journal 157 and the smooth shaft portion of bolt 163 are about an inch long to prevent canting since the handle 161 must of necessity be some distance from riser 154 and stop member 152. Since the shaft portion (excluding the threaded end) of bolt 163 is smooth, lever assembly 162 can easily be pivoted between an operative and inoperative position. Bottom plate 160 and/or handle 161 could be of a longer length to accommodate the differences in finger sizes so that locking means 150 can be operated as efficiently as possible.

Frame 125, since it is removable, allows the loader 1 not only to be used in and on a bow with a modified riser as seen in FIGS. 1–7, but also on a bow with a conventional handle riser. However, frame 125 could be constructed without flanges 138 and 136, and instead, shelf 140 could extend to the right to provide section 142 and extend to the left to provide section 144. Consequently, horizontal section 131 would then extend to provide shelf 145 that would be of the same length and width as track means 63. Assuming frame sections 20 and 40 are not attached to the bottom of the track means, the bottom of track means 63 could then be attached flat against the top surface of shelf 145. Front surface 141 would then be extended forward at an angle to provide bracket 31 and arrow support shelf 35. The right rear vertical surface 143 would extend at right angles to provide vertical flange 45. Retention wall 29 would still be attached to the left end of the vertical side of track 66. A frame without downward extending flanges would probably be preferable to archers and hunters that only intend to use conventional bows. It should be understood that frame 125 could be constructed so that flange 127 would be farther to the right and that plate 131 could extend to the right at right angles and then extend to shelf 145. Frame 125 would then be in the shape of an "L" instead of a "T". In other words, frame 125 could then be attached to the right side of the riser. When the loader 1 is mounted to the rear of the conventional bow handle riser and the few adjustments and/or modifications made, the loader will still operate the same way as when mounted in and on the modified riser 5 of FIGS. 1–9.

Operation of Loader of FIGS. 1–13

To review briefly, the arrow holding and loading device 1 is mounted on modified bow 3 by means of a support frame assembly 2 and a major part of the assembly is track means 63. The riser 5 of bow 3 has an opening 7 which is large enough for the mounting of the frame assembly and for the passage of carriage 99 through the opening on track means 63. The carriage 99 indexes horizontally at right angles to the plane of the bow and has a plurality of arrow support stations. The first station is for the initial or first arrow A1 to be shot and is defined by spacer pad 12, which is attached to riser wall 8, and by arrow rest 58. The second station is for the follow-up arrow A2 and is defined by wall 68 and arrow rest 58 after it has pivoted back to the up position. Station 2 is parallel to but transversely separated from the first station by a very short distance, preferably in the range of 1.0 to 1.5 inches or less.

Since follow-up arrow A2 must be supported while initial arrow A1 is being aimed and shot and since it must be moved into the shooting position in the plane of the bow, the second (and subsequent) stations have a holding, stabilizing, and clamping means for holding the follow-up arrow tightly on the carriage. Arrows in the second (and subsequent) stations are additionally stabilized, if desired, by resting on the shelf 35 of stabilizer means 34. The device, therefore, contacts each follow-up arrow at several axially spaced points along its length to firmly hold it in a pre-shooting position parallel to the shooting position during movement of the bow and the vibration associated with release of an arrow.

A latch means, including a latch arm and latch wall, is provided to lock each holder and stabilizer member in operative position wherein the arrow is seated in V-shaped troughs which are preferably sized to provide pressure to clamp arrow A2 against face 70 of wall 68 and arrow A3 against face 86 of wall 88. When arrows A2 and A3 (i.e., either or both) are in the stored position, arrow holders 50 and 55 are not able to release their grip on arrows A2 and A3 until each is in the shooting position, i.e., the position which is clear of the retention wall 29.

The carriage 99 is indexed automatically in its operative direction from left to right by the spring motor 117. Indexing cannot occur if the plate 53 is in the up position since its arm 54 will engage one of the stop faces on the carriage. However, when an arrow is released, its fletching or other projection contacts movable plate 53 and causes it and its attachment arm 54 to pivot forward and down (assuming lock means 100 is in the unlocked position) thereby releasing carriage 99. As the carriage moves rightward in the tracks, it pushes against cam 61 thereby causing plate 53 to return to the up and blocking position. The rightward movement of carriage 99 was again stopped when it engaged arm 54 of plate 53 which simultaneously placed the next arrow in the shooting position. Indexing can be prevented by manual operation of the finger actuated stop or lock means 100 to place stop member 106 in the path of movable plate 53.

When the archer is ready to load the device, arrow A3 is placed against vertical wall 88 and the arrow holder manually pivoted from left to right and then pushed tightly against arrow A3. At this point, the archer pushes the arrow holder forward, thereby, locking the latch arm behind the latch wall. When an archer is clamping an arrow for storage, the arrow should be adjusted and positioned so that when it is brought from the stored position to the shooting position its nock will engage (if using a modified nock of my copending U.S. application Ser. No. 076,798 for side engagement) or be near string 18 for quick nocking. Since arrow A3 is locked in place, the carriage is pushed far enough leftward so that plate 53 can be raised to the operative position which holds arrow A3 in the stored position. Arrow A2 can be clamped in its holder in the same way as arrow A3 and the carriage again pushed leftward until plate 53 can be positioned to hold arrows A3 and A2 in the stored position. Arrow A1 can now be loaded, drawn and released.

FIG. 4 shows the loader an instant after the release of arrow A1, and plate 53 has been pivoted down by A1's vane. Arm 54 is no longer blocking carriage 99 and it is automatically pulled rightward. Plate 53 is automatically pivoted up and blocks the carriage's rightward movement. Arrow A2 is now in the shooting position and is nocked, drawn (automatically freed from its holder), and released. As arrow A2 passes over plate 53, the plate is pivoted down which releases the carriage for rightward movement until arrow A3 is in the shooting position. Arrow A3 is nocked, drawn (automatically freed from its holder), and released. When using the loader 1 on bow 3, a proficient archer can nock, draw, aim, and release a plurality of arrows in a very short period of time.

Again, it should be noted that the construction of the loader could be such that its length could be extended so that it could hold more than two follow-up arrows. Also, the modified bow 3, by removing the loader 1, can easily be used in the conventional manner by inserting and attaching plug 101. Plug 101 provides hole 103, which is standard on bows, for the attachment of arrow rests, and other archery assist devices.

In line with the "overdraw" concept, the loader 1 can be mounted to the rear of conventional bow handle risers as shown in FIGS. 10–13. This can be accomplished by attaching frame assembly 2 to frame 125 which then can be securely bolted to the bow riser. After a few adjustments are made, loader 1 will operate the same way as when mounted on the modified bow riser 5 of FIGS. 1–9.

It will be seen that the arrow holding and loading device 1 of FIGS. 1–7 can be used with a modified bow riser and (if using an auxiliary frame) can be used also with a wide variety of bows to provide an archer with one or more fast follow-up shots using arrow A2, A3, etc. The stations for the respective arrows can be placed very close to each other so that the arrows are only an inch or so apart. The follow-up arrows are parallel to the first arrow A1 in the shooting position and need only be moved sideways by carriage 99 for an inch or so to be delivered to the shooting position from the last pre-shooting position. This small movement minimizes visual disturbance of the environment. The various metal parts can be well lubricated and/or padded to minimize noise and auditory disturbance of the environment. Shooting of the first arrow A1 triggers automatic movement of carriage 99 to deliver the first follow-up arrow to the shooting position, ready for nocking, drawing, aiming, and release by the archer. Similarly, shooting of the first follow-up arrow A2, triggers automatic delivery of the second follow-up arrow A3 to the shooting position, ready to be shot by the archer. This automatic delivery of each follow-up arrow, along with the small amount of sidewise movement of the arrow, enables the follow-up arrow to be nocked and shot very rapidly, especially if a special nock is used that provides sidewise engagement of the string.

The device 1 can enable the archer with experience to release follow-up arrow A2 within about two seconds after release of arrow A1. The fast, automatic delivery of the follow-up arrows A2, A3, etc. also improves accuracy because the archer's attention and movements can be focused almost exclusively on shooting. It is not necessary for him or her to search for and load the follow-up arrow.

The device 1 is sturdy and compact in construction, easy and quiet to use, operates rapidly and smoothly. It drastically reduces the amount of time between arrow releases. It delivers each of the follow-up arrows consistently to the same position so that the archer can have a smooth, economical, rhythmic, hand-arm motion in shooting. The benefits to the hunter are obvious. For sport archery, the speed of the device can add another dimension to target shooting by making it possible to quickly and accurately shoot at moving and/or multiple targets.

Loader of FIGS. 14–20

Figure 14:
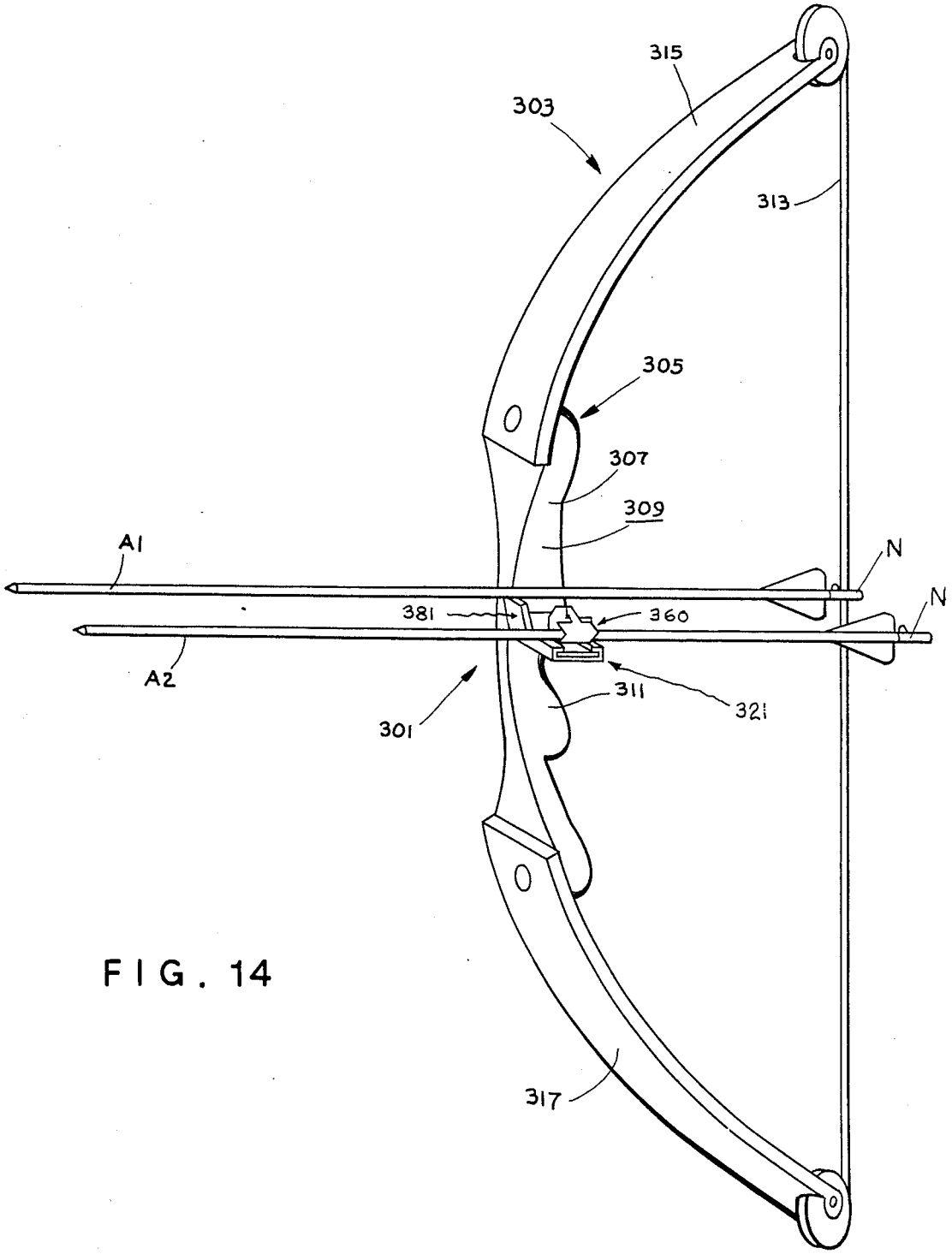
FIG. 14 is a perspective view of an archery bow with a modified loader for two arrows and therefore having a track of minimum length according to the invention secured to it.

As seen in FIG. 14, an arrow holder and loader 301, according to this embodiment of the invention, is shown mounted on a bow 303 which may be any of a wide variety of constructions. The bow 303 illustrated is to be used by a right handed archer and has a central riser section 305 to which are secured upper and lower resilient limb sections 315 and 317, respectively. A bow string 313 is attached by suitable means to the ends of the limb sections and has a nocking point (not shown in detail) that defines one end of a "center line" for the bow 303, the other end being defined by the point where a nocked arrow would be properly supported on the riser section 305 in proper shooting position to be shot by the archer. The "plane" of the bow may be regarded as the plane which contains this center line and the bow string 313.

As is conventional, the riser section 305 has a hand grip portion 311 (FIG. 14) adapted to be grasped by the left hand of the archer. The hand grip portion 311 is located on the left side (as seen by the archer) of the plane of the bow. Just above it and offset to the right of the portion 311 is the offset bow window portion 307 that includes a flat vertical wall (often called the "arrow plate") 309 that is substantially parallel to and located slightly to the right of the plane of the bow.

The arrow holder and loader 301 of this embodiment of the invention has a support frame 321 (FIG. 16) to secure it to the riser 305. It may be formed from sheet metal and have a flat vertical flange section 325 that is in solid contact with wall 309. Flange 325 is held against wall 309 by bolt 329 which passes through hole 327 and is then secured by bolt 328. The support frame 321 includes a rectangularly shaped horizontal shelf 323 which extends to the left of wall 309 as seen by the archer.

A track means or assembly 344 is rigidly attached, as by welding or bolting, to the top of shelf 323 and therefore to the riser section 305. The assembly 344 includes parallel rails 345 and 346, best seen in FIGS. 17 and 18, which extend at right angles to the plane of the bow. From the archer's position, the track assembly is located on the left of the riser section 305. In the embodiment of the invention illustrated, the rails are opposite sides of a C-shaped channel having its back flat against and secured to the top of shelf 323.

Plate 333 has been bent to form four sections (FIGS. 15–18). The end section of plate 333 is vertical and perpendicular to the plane of the bow and forms plate or retention wall 335. At the bottom of vertical wall 335, plate 333 is bent at right angles to form horizontal plate 334 which is attached (as by welding or with bolts) to the bottom of shelf 323. At the front edge of shelf 323, plate 333 bends upwardly to form a strut portion 338. About half way up on the right and left sides of strut 338 are two vertical flanges 337 which are equal distance from the front edge of shelf 323. They are identical in size and shape. In the paired flanges 337 are corresponding holes (not shown) which receive shaft 390. At the top of strut 338, plate 333 again bends to form plate or shelf portion 385. The elements of plate 333 will be discussed in detail later.

Figure 16:
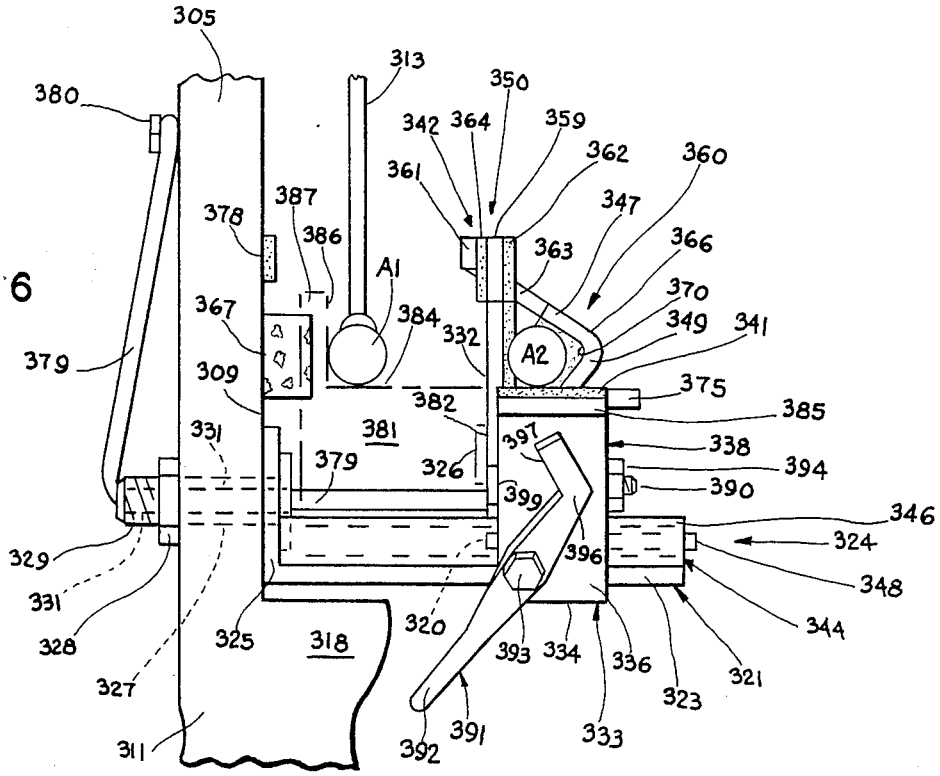
FIG. 16 is a front elevation of the loader as shown in FIG. 15.
Figure 17:
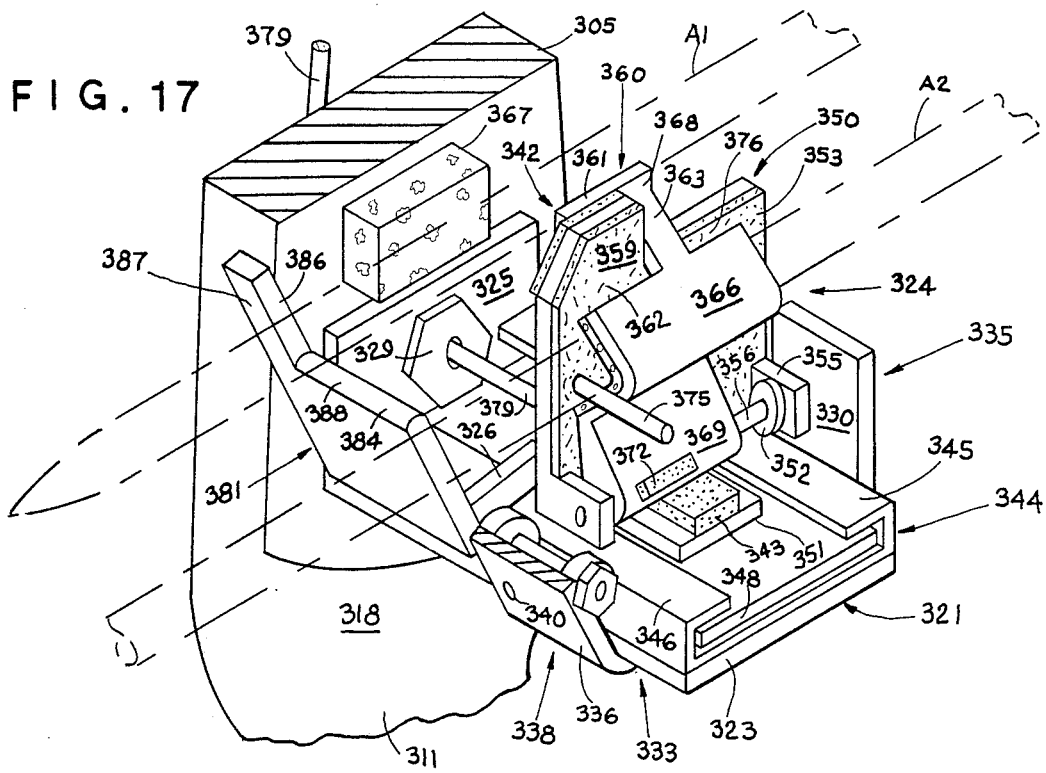
FIG. 17 is a perspective view (with parts omitted) of the loader as shown in FIGS. 15 and 16 and especially showing the carriage release mechanism.
Figure 18:
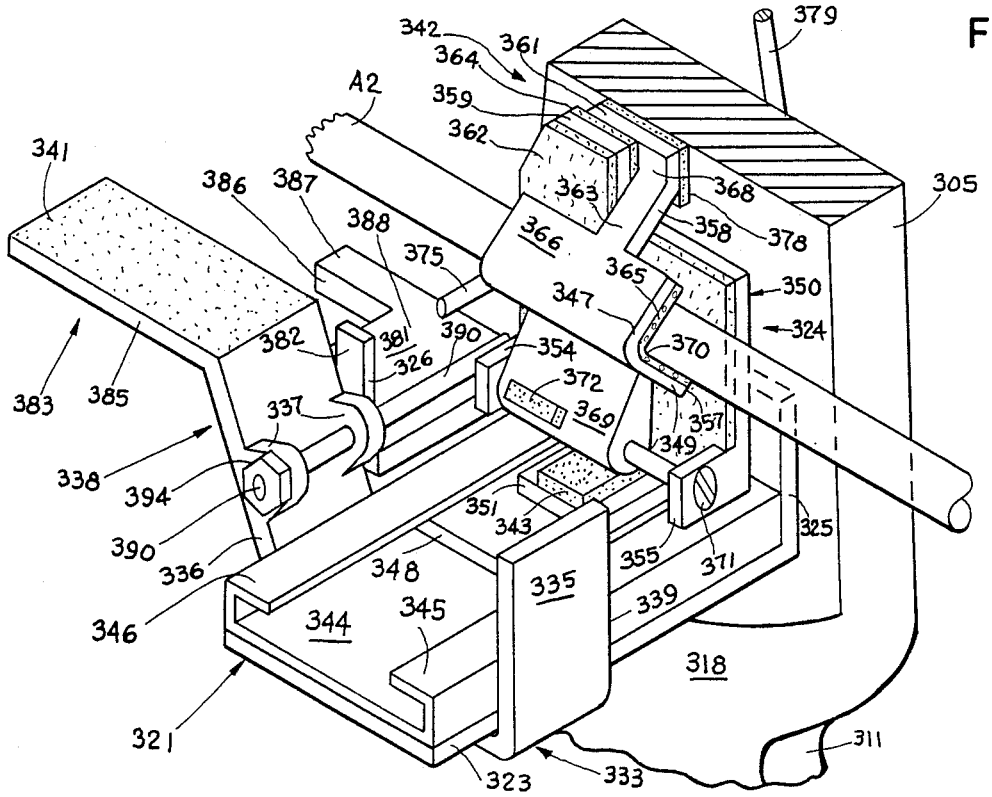
FIG. 18 is a perspective view of the loader and shows how the released arrow A1 has depressed the arrow rest plate to permit indexing of the carriage.

Rectangular plate 381 has an extended portion 387 which also is rectangular in shape (FIGS. 16–18). Plate or arm 326 extends at right angles from plate 381. Arm 326 extends back toward the archer and is parallel to the plane of the bow. Attached on the back (facing the archer) and near the bottom of plate 381, is rod or shaft 390. It extends from the right end of plate 381 and passes through a washer 399, through the corresponding holes in flanges 337, and is then secured by self-tightening nut 394. Washer 399 (FIG. 16) separates plate 381 from strut 338. Rod 390 has a smooth shaft surface so it can turn easily in the holes of the paired flanges 337. Rod 390 is only threaded on the portion that extends past the left flange 337. Plate 381 is an integral part of rod or shaft 390. Therefore, as plate 381 is pivoted forward or backward, shaft 390 correspondingly turns in flanges 337. The various functions of plate 381 will soon be realized.

An arrow carriage assembly 324 (to hold and load arrows) is mounted on the track means 344 provided by the channel shaped rails 345 and 346 to move between a fully loaded position at the left ends of the rails (FIGS. 16 and 17) and an unloaded position (not shown) at the right ends of the rails. The carriage assembly 324 includes a substantially flat plate-like traveler member 348 that fits in and slides in the channel rails 346 and 345. As best seen in FIGS. 16 and 17, which show a loader for two arrows (an initial or first arrow and one-follow-up arrow), the member 348 carries one rigid vertical arrow alignment wall 350 which is parallel to the plane of the bow. Wall 350 is located at the right end 320 of the member 348 (as seen by the archer). It has a right angle foot or flange 351 (FIG. 17) at the bottom which sits on top of plate 348 and is rigidly secured to it (as by welding). As will be subsequently recognized, guide wall 386 of plate 381 defines a first arrow alignment station for an arrow A1 (which is on the center line of the bow or shooting position ready to be shot); the wall 350 defines, in effect, a second arrow alignment station and pre-shooting position for the follow-up arrow A2. Arrow A2 can be shot when it is moved by the carriage into the plane of the bow so that the arrow A2 is substantially coaxial with the center line of the bow, i.e., in the shooting position.

Figure 20:
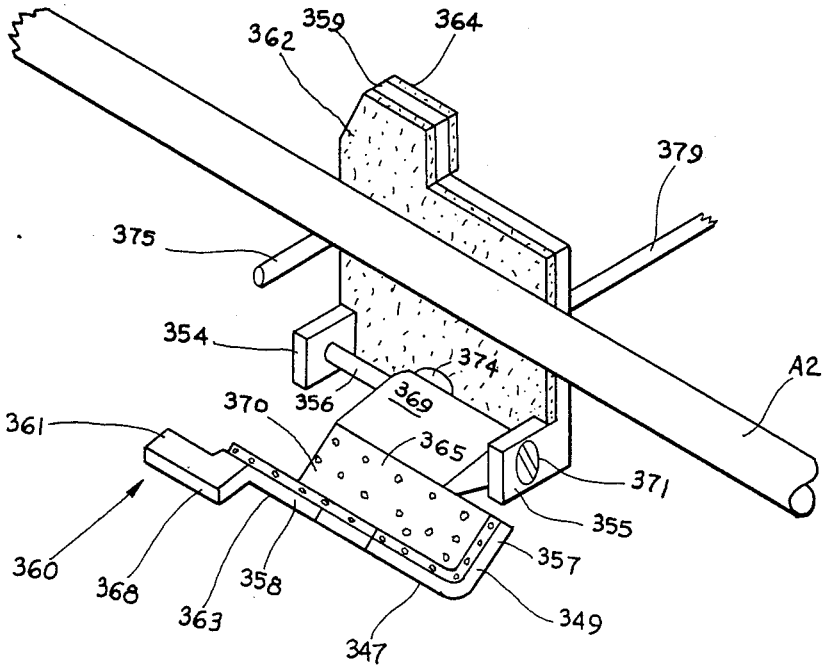
FIG. 20 is a perspective view similar to FIG. 19 but with the arrow clamp in the open position to permit the drawing and release of arrow A2.

The left side of wall 350 is preferably covered with a layer or face 362 of relatively soft, non-metallic, sound-deadening material (such as material being sold under the trademark "Velcro") and it is this layer which engages, positions and guides arrow A2 as shown in FIG. 20. Guide wall 386 of plate 381 is also covered with corresponding "Velcro" layer 388 which engages, positions, and guides arrow A1 (FIGS. 16 and 17).

Loader 301 supports two arrows (A1 and A2), i.e., a two station mechanism. The first station, for the initial arrow A1, is represented by wall 386; and the second station, for the follow-up arrow A2, is represented by wall 350. Arrow A1 is on the center line of the bow and in shooting position (FIGS. 16 and 17). However, before follow-up arrow A2 can be released, it must be moved transversely to the right (as seen by the archer) so that wall 350 assumes the transverse position now occupied by wall 386. During this movement and during all the period that arrow A2 is aligned against wall 350, the archer is concerned with arrow A1 and his hands are not available to hold arrow A2 in a proper position. Accordingly, the loader 301 includes an arrow holding, stabilizing, and clamping means 360 for station 302 so that follow-up arrow A2 is firmly held in the proper position until it is ready to be grasped and pulled back by the archer.

On the left side near the bottom of plate 350, at the front and back, two vertical plates, 354 and 355, extend leftward at right angles (FIGS. 17–20). Plate or flange 355 has a counter-sunk hole (facing the archer) while flange 354 has a threaded hole. The holes are on the same horizontal plane and are equal distance from plate 350. The journal portion 369 of arrow holder 360 also has a hole which runs longitudinally and corresponds in size to the holes in flanges 354 and 355. Screw 371, with countersunk head, is inserted through the hole in flange 355, pushed through the hole in the journal section 369, and then screwed into the threaded hole in flange 354. Except for the threaded portion that screws into flange 354, the rest of the shaft of screw 371 is smooth so arrow holder 360 can easily slide back and forth between flanges 354 and 355 or pivot left or right. Just above journal 369 is clamp section 366 with top flat plate section 347 and bottom flat plate 349 which together form horizontal V-shaped trough 370. Clamp section 366, and consequently trough 370, are parallel to the plane of the bow. The trough 370 has a cork lining 365 (or similar material) to help grip stored arrow A2. Following the same plane as top plate 347 and extending upward is riser 363. It is bent back near the top to form portion 368 which extends forward to form rectangularly shaped section 361 (best seen in FIG. 19). The top of riser 363 is bent in such a way so that portion 368 and its extended arm 361 are vertical and parallel to the plane of the bow when clamped tightly around arrow A2. At the top of plate 350 is section 359 whose back or right side is covered with "Velcro" 364. Section or latch wall 359 is also vertical and parallel to the plane of the bow. Therefore, when latch mechanism 342 is operative, i.e., when latch arm 361 is completely behind (to the right of) latch wall 359 and "Velcro" padding 364, there is consistent pressure throughout all the contact points.

In order for arrow A2 to be loaded, the carriage assembly 324 must be in the loading position. Loading is in reverse order, i.e., arrow A2 is loaded first and arrow A1 second. If the loading of A2 were attempted with the carriage assembly 324 in the stored position, this would not be possible because of retention wall 335. If arrow holder 360 were slidably pulled back (in stored position), the back bottom portion 357 of clamp plate 349 (FIG. 15) would engage flat surface 330 of retention wall 335 thereby preventing latch arm 361 from being able to go behind latch wall 359. The distance between stop face 357 and abutment surface 330 is about ⅛ inch less than is needed for arrow holder 360 to be pulled back so that latch arm 361 will have clearance to go behind latch wall 359. The purpose of retention wall 335 will be discussed later.

Figure 19:
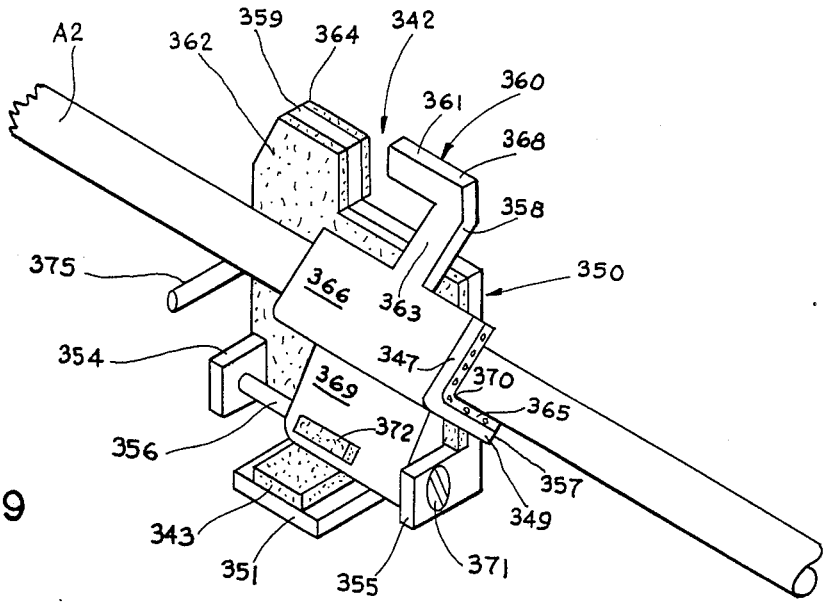
FIG. 19 is a perspective view (with structure omitted) of the loader and intended primarily to show the arrow clamp and clamp latch mechanism.

If the archer is ready to load arrow A2 for storage, then the carriage 324 will be positioned to the far right in track means 344, i.e., the shooting position. In the shooting position, the full backward movement of arrow holder 360 will no longer be restricted by wall 335, therefore latch arm 361 has clearance to pass by and latch behind latch wall 359. The archer positions the arrow nock at the desired return point on or near string 313. Arrow A2 shaft is placed on arrow rest 375 extending from plate 350 against "Velcro" surface 362 of plate 350. Arrow holder 360, in the open position at this point (FIG. 20), is manually pivoted to the right so that arrow A2 is trapped horizontally in trough 370 (FIG. 19). Rightward pressure is applied by the archer and more tightness around arrow A2 is gained because the cork lining 365 in trough 370 and the "Velcro" facing 362 on plate 350 are compressed. With the rightward pressure still applied, the archer pushes forward against end face 358 of riser 363 which causes the arrow holder 360 to slide forward on shaft 356. Latch arm 361 is an integral part of arrow holder 360, therefore latch arm 361 also moved forward and consequently went tightly behind "Velcro" 364 and wall 359. Latch means 342 is now operational and has arrow holder 360 locked in place with clamp 366 firmly holding arrow A2 (best seen in FIG. 18). Arrow A2 is tightly held along its axis by pressure from top plate 347 and bottom plate 349. Arrow A2 is also against the top of arrow rest 375. Since the cork lining 365 is gripping arrow A2 tightly, arrow A2 was also pulled forward the ⅜ inch or so. The "Velcro" facing 362 of plate 350 is smooth and did not bind against A2 and it was pulled forward. So that arrow A1 can be positioned and shot, arrow A2 must be moved out of the way. Therefore, the archer manually slides the carriage 324 with clamped arrow A2 leftward in track means 344. The storage position is reached when the left end of carriage traveler member 348 is about flush with the left end of track means 344 and the forward portion of A2 is resting upon "Velcro" 341 of shelf 385. Support means 383, comprising shelf 385 and "Velcro" padding 341 (for quietness), helps stabilize arrow A2 during the vibration associated with the release of A1.

After arrow A1 is shot, arrow A2 must be transferred from the stored position to the shooting position. This is accomplished by sliding carriage 324 in the track means 344 from left to right as best shown in FIGS. 17 and 18. It is preferred that the carriage 324 be moved from left to right by energy stored in a stretched elastic cord 379. There is a hole (not shown) near the bottom of vertical plate 350. The hole is counter sunk in design on the left side of plate 350, i.e., the hole narrows in diameter the closer it gets to the right or back side of plate 350. So that elastic cord 379 won't pull completely through the hole in plate 350, a round-headed clasp 374 is attached to one end (FIG. 20). A knot at the end of cord 379 would serve the same purpose as a round-headed clasp. So that the elastic cord 379 will be operational, one end (the end without the clasp or knot) is started from the left side of plate 350 and pushed through the hole. As best shown in FIGS. 16 and 17, the non-headed end of cord 379 is then threaded through hole 327 (which is smooth including rims to prevent damage to the elastic cord) of bolt 329 so that it emerges from the threaded end. Cord 379 is stretched, turned upward, and anchored around bolt 380 which is screwed into the right side of riser 305. The elastic cord 379 is long enough to supply the required energy at the required rate. Elastic cord 379 is operational since one end is anchored to the carriage 324 and the other end to the bow riser 305. If the carriage 324 is pulled to the left (stored position) and released, the stretched elastic cord 379 will pull it back to the right, i.e., the shooting position.

Figure 15:
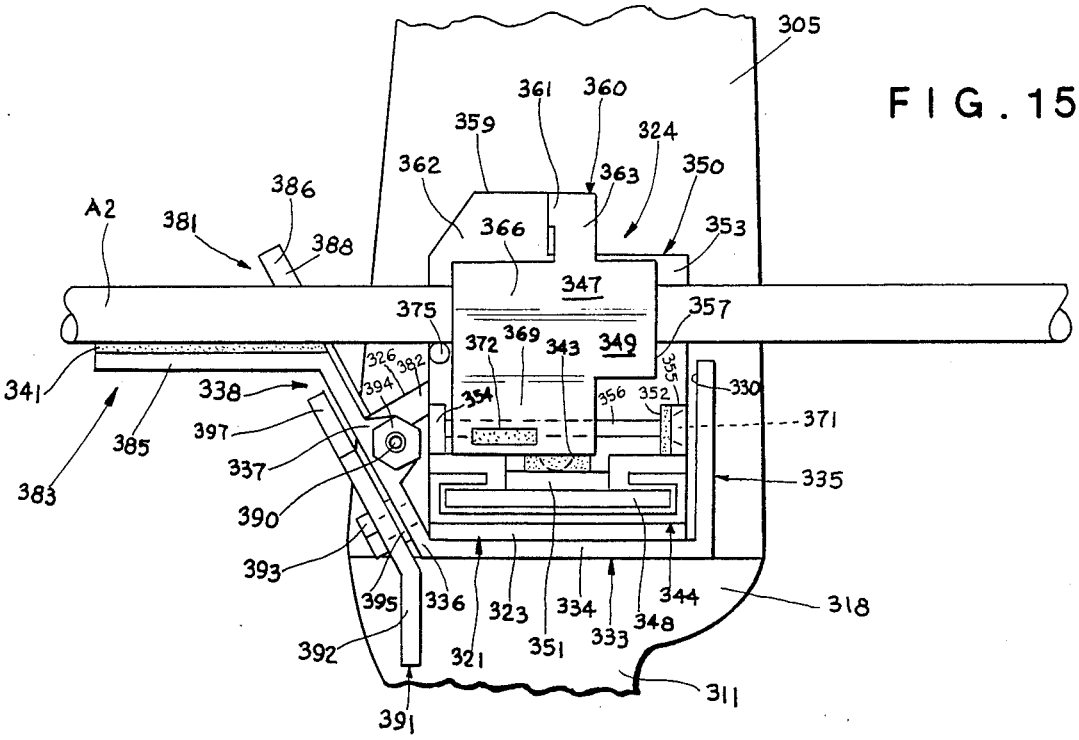
FIG. 15 is an enlarged side elevation of the loader attached to the bow handle (with parts broken away) as shown in FIG. 14.

Arrow A2 must be held in the stored position and out of the way if arrow A1 is to be loaded and shot. Therefore, since the carriage (with arrow A2) is urged back to the shooting position by elastic cord 379, plate or arm 326 with stop face 382 provide a stop and positioning means (FIGS. 15, 16, and 17). Plate 381 is perpendicular to the plane of the bow and therefore parallel to the track means 344. Arm 326 extends at a right angle (towards the archer) from plate 381 and is parallel to the plane of the bow as is carriage plate 350. Consequently, if plate 381 is in the "up" position, then arm 326 will be in the path of carriage 324 and stop face 382 will abut against the back portion 332 of plate 350. Arrow A2 will remain in the stored pre-shooting position until arm 326 disengages carriage plate 350.

Plate 381 not only is part of the stop and positioning means, but also supports the front of arrow A1 on arrow rest portion 384 (FIGS. 16 and 17). In order for arrowrest 384 to be at the correct elevation for consistent shooting, plate 381 should be on the same angular plane as strut 338 (FIGS. 15 and 16). So that the archer can more easily place plate 381 in the "up" and operable position, a small piece of "Velcro" (not shown) can be adhered to the back 332 of carriage plate 350. It should be so positioned that when the rear portion of arm 326 abuts against the piece of "Velcro", not only will stop face 382 be in place, but arrow rest 384 of plate 381 will be at the correct elevation. Extended section 387 of plate 381 is of the proper width so that guide wall 386 keeps arrow A1 the same distance from arrow plate 309 as is arrow A2 when the carriage 324 has moved to the shooting position. Arrow A1 and A2 must be equal distance from the arrow plate when each is in the shooting position for consistent aiming, drawing and releasing.

An archer might decide to move around with arrows A1 and A2 in position on the loader 301. While he or she is moving around, the front shaft portion of A1 might "bounce" somewhat and pivot plate 381 forward. This could result in arrow A1 being shot on a lower plane than desired, or an unwanted release of carriage 324 from the stored position. Therefore, locking means 391 is provided to keep plate 381 in the correct "up" position (FIGS. 15 and 16). Locking means 391 is in the form of a lever that is movably mounted on the front side of strut 338. Bolt 393 is inserted through a hole (not shown) in the mid-section of lever 391, through washer 395, then screwed into hole 340 (FIG. 17). The portion of bolt 393 that lever 391 pivots on is smooth and the threads are self-tightening for adjustment of tightness or looseness of lever 391 movement. At the top of lever 391 is rightward extended portion 396 (as seen by the archer). On the back of portion 396 is stop face 397. A handle 392 at the bottom is for the operation of the lever 391. If the archer wants to lock plate 381, then the forefinger on the left hand (assuming the archer is using a right-handed bow) would push the handle 392 leftward, thereby pivoting stop face 397 in front of plate 381. Pivoting the handle with the forefinger to the right brings stop face 397 out of engagement with the front of plate 381.

When an archer is walking around with arrows A1 and A2 on the loader 1, it is possible that stored arrow A2 could be pushed against something, thereby moving it back. Because of the tight grip of the corklined trough 370, and because a carriage plate 350 is "Velcro" faced, arrow holder 360 would also be pushed back. However, the arrow holder 360 will only travel about ¼ inch before end portion 357 abuts against side 330 of the retention wall 335. Latch arm 361 also traveled about ¼ inch since it is an integral part of arrow holder 360. Latch arm 361 needs at least about ⅜ inch backward travel in order to clear latch wall 359 so that it can spring open. Therefore, retention wall 335 will prevent a premature release of stored arrow A2. All that is needed to return holder 360 to its previous fully latched position, is a forward push on side portion 358.

If the archer is ready to operate the loader 301, he or she positions arrow A2 so the arrow nock will return to a position on (if using an arrow nock that can engage the string from the side) or near the string 313 for quick nocking; arrow holder 360 is pivoted to the right and clamped around A2, then slidably pushed forward on shaft 356 thereby locking latch arm 361 behind latch wall 359; carriage 324 with clamped arrow A2 is manually slid leftward in tracks 345 and 346 to the stored position; plate 381 is manually pivoted to the "up" position so stop face 382 can engage the back of plate 350; carriage 324 is released and is pulled tight by elastic cord 379 against stop face 382 of arm 326 which holds plate 381 in the "up" position; and, the nock of arrow A1 is positioned on the string 313 and then the shaft is placed on arrow rest 384. When the archer is ready to shoot, arrow A1 is drawn and released. The bottom vane of A1 engages and passes over plate 381. This causes plate 381 to pivot forward and down. Arm 326, an integral part of plate 381, is pivoted forward at the same time thereby disengaging stop face 382 from the back of carriage plate 350. Since the path of carriage 324 is no longer blocked, it is immediately pulled by energy stored in the stretched elastic cord 379. The rightward movement of the carriage 324 is stopped when it comes into contact with the shock absorbing sponge 367 and the "Velcro" pad 378 which are adhered to the bow handle riser 305 (FIGS. 16–18). The sponge 367 is of a selected thickness and stiffness so that after absorbing the shock, it will push carriage 324 back to the exact shooting position. When the arrow holder 360 is in the shooting position it is clear of the retention wall 335. Therefore, arrow holder 360 will not be prevented from opening. At this point, the archer reaches and grabs the nock of A2. Then, in one continuous backward movement, arrow A2 is nocked on the string 313 and pulled to a full draw. As the arrow A2 was being pulled back, the grip of the corklined trough 370 also caused arrow holder 360 to be slidably pulled back on shaft 356 (FIG. 19). As soon as latch arm 361 was clear of latch wall 359, arrow holder 360 automatically pivoted leftward on shaft 356 (FIG. 20). When corklining 365, "Velcro" facing 362, and "Velcro" facing 364 were no longer locked in a compressed state, they springably returned to an uncompressed state thereby pushing arrow holder 360 away from arrow A2. As arrow holder 360 was pulled back for release, sponge 372 of bottom portion 369 came in alignment with sponge 343. When arrow holder 360 pivoted leftward, the two sponges engaged each other which slowed down and stopped arrow holder 360. This prevented it from hitting retention wall 335 or track rail 345. Arrow rest 375 continued to support arrow A2 after arrow holder 360 pivoted leftward. Now that arrow holder 360 is out of the way and the shaft of arrow A2 is supported by arrow rest 375, the archer releases A2. There are different kinds of arrow rests on the open market that can function as arrow rest 375. One that allows arrow A2 to easily pass over without distorting its flight is the best type to use.

The short track type loader of FIGS. 14–20 can also be used in the overdraw position by attaching flange plate 325 to the attachment arm (FIGS. 33, 34 of the pivot type loader of FIGS. 21–35) by bolt 329. The pivot type locking means 575 (described hereinafter) can also be used on the short track type. However, bolt 393 would be replaced with a longer bolt.

To review briefly, the arrow holding and loading device 301 is mounted on bow 303 by means of a support frame 321. A carriage assembly 324 indexes horizontally at right angles to the plane of the bow by sliding in track means 344. The carriage 324 is structured so as to hold only one follow-up arrow. The first station is for the initial or first arrow A1 to be shot and is defined by guide wall 386 and arrow rest 384. The second station is for the follow-up arrow A2 and is defined by the wall 350 and arrow rest 375. It is parallel to, but transversely separated from the first station by a very short distance, preferably in the range of 1.0 to 1.5 inches or less. Since follow-up arrow A2 must be supported while initial arrow A1 is being aimed and shot and since it must be moved into the shooting position in the plane of the bow, the second station has a holding, stabilizing, and clamping means 360 for holding the follow-up arrow tightly on the carriage 324. Arrow A2 is additionally stabilized by resting on shelf 385 of stabilizer means 383.

A latch means 342 including latch arm 361 and latch wall 359 is provided to latch the holder and stabilizer member 360 in operative position wherein the arrow is seated in a V-shaped trough 370 which is preferably sized to provide pressure to clamp arrow A2 against face 362 of wall 350. Flat plate shims may be used between corklining 365 and the top and bottom plates 347 and 349 of clamp 366 so the proper amount of pressure can be applied to arrows of various sizes. Latch arm 361 is not permitted to disengage latch wall 359 if carriage 324 is in the stored position because of retention wall 335. When the carriage 324 is in the shooting position, then the archer can release latch arm 361 from latch wall 359.

The carriage 324 is indexed automatically in its operative direction from left to right by the elastic cord 379. However, indexing cannot occur if plate 381 is in the up position because stop face 382 is engaged with the back of plate 350 (FIGS. 16 and 17). However, when arrow A1 is released, movable plate 381 is forced forward and down by the vane, etc., on the arrow. This moves stop face 382 out of engagement with the back of plate 350 of the carriage (assuming lever 391 is not blocking plate 381). The carriage is then automatically indexed to the right until it is stopped by wall 309 of riser 305 thereby positioning arrow A2 in the shooting position. Indexing can be prevented by manual operation of the finger actuated lever 391 to place stop face 397 in the path of plate 381.

FIG. 18 shows the loader 301 an instant after the archer has released arrow A1. The radial vane or fletching of A1 has passed across arrow rest 384 which pivoted plate 381 forward and clear of wall 350. Therefore, movement of the carriage was no longer restricted and it moved from left to right so that arrow A2 was placed in the shooting position. Now that carriage 324 is in the shooting position, retention wall 335 will no longer block arrow holder 360. As arrow A2 is nocked and drawn back, arrow holder 360 is also drawn back (FIG. 19). As soon as latch arm 361 disengages latch wall 359, arrow holder 360 automatically pivots leftward thereby losing its grip on arrow A2 (FIG. 20).

After A2 has been shot, the device may be reloaded. This is done in reverse order because of retention wall 335. Thus, with station 2 in the shooting position, arrow A2 is clamped in position on wall 350; the carriage is pushed leftward until plate 381 can be placed in the "up" and blocking position. The first arrow to be shot, arrow A1, is loaded secondly.

It will be seen that the arrow holding and loading device 301 of FIGS. 14–20 can be used with a wide variety of bows to provide an archer with a fast follow-up shot using arrow A2. The stations are very close to each other so that the arrows are only an inch or so apart. The follow-up arrow A2 is parallel to the first arrow A1 in the shooting position and need only be moved sideways by carriage 324 for an inch or so to be delivered to the shooting position from the last pre-shooting position. This small movement minimizes visual disturbance of the environment. The various metal parts can be well lubricated and/or padded to minimize noise and auditory disturbance of the environment. The automatic delivery of arrow A2, along with a small amount of sidewise movement of the arrow, enables the follow-up arrow to be nocked and shot very rapidly. The device 301 can enable the archer with experience to release follow-up arrow A2 within about two or three seconds after release of arrow A1. The fast, automatic delivery of follow-up arrow A2 also improves accuracy because the archer's attention and movements can be focused almost exclusively on shooting. It is not necessary for him or her to search for and load the follow-up arrow.

The device 301 is sturdy and compact in construction, easy and quiet to use, operates rapidly and smoothly, and can be attached to most bows. It drastically reduces the amount of time between arrow releases. It delivers the follow-up arrow consistently to the same position so that the archer can have a smooth, economical, rhythmic, hand-arm motion in shooting.

Pivotal Loader of FIGS. 21–35

Figure 21:
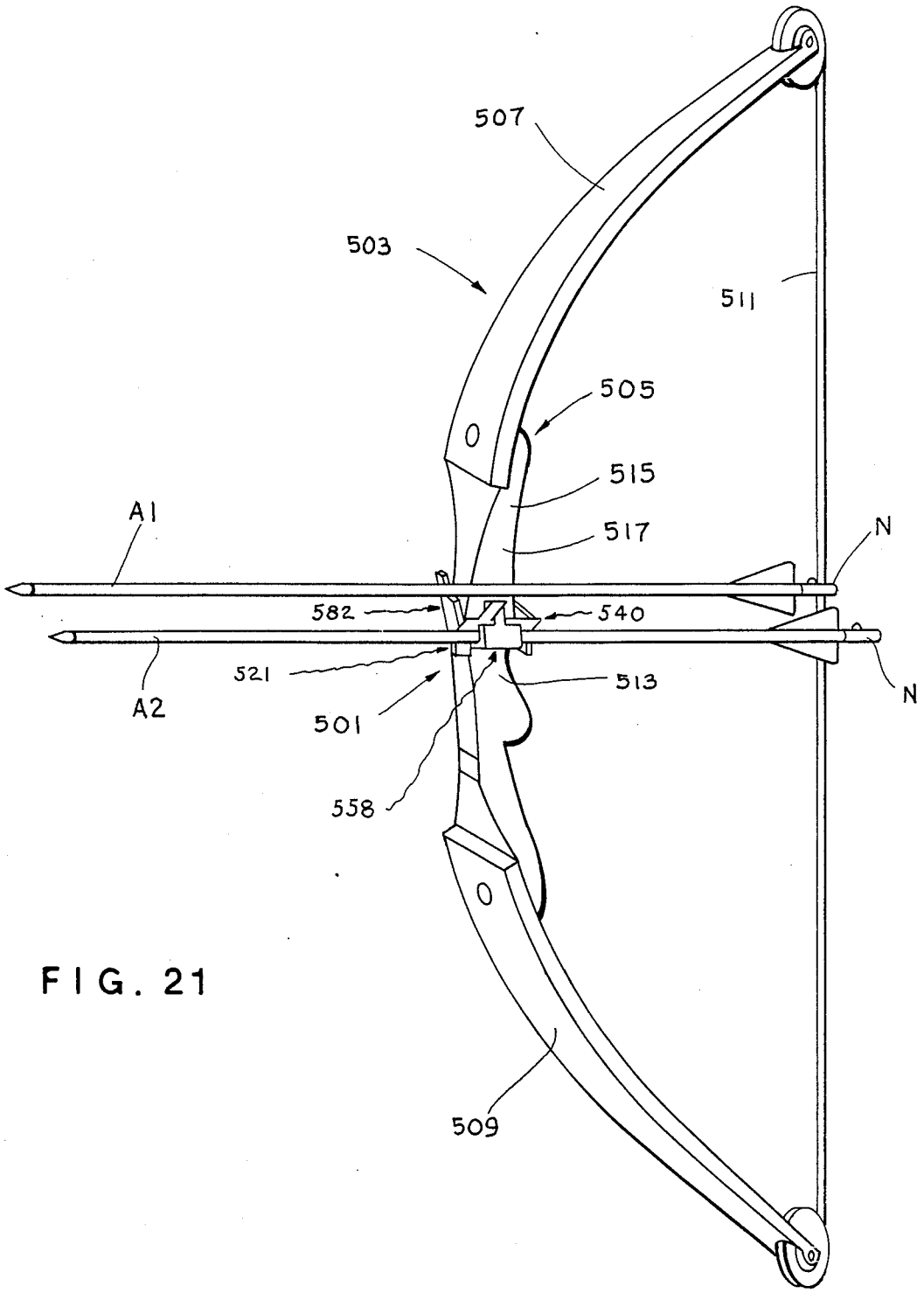
FIG. 21 is a perspective view of an archery bow with a pivotal loader according to the invention secured to it.

As seen in FIG. 21, an arrow holder and loader 501, according to this embodiment of the invention, is shown mounted on a bow 503 which may be any of a wide variety of constructions. The bow 503 illustrated is to be used by a right handed archer and has a central riser section 505 to which are secured upper and lower resilient limb sections 507 and 509, respectively. A bow string 511 is attached by suitable means to the ends of the limb sections and has a nocking point (not shown in detail) that defines one end of a "center line" for the bow 503, the other end being defined by the point where a nocked arrow would be properly supported on the riser section 505 in proper shooting position to be shot by the archer. The "plane" of the bow may be regarded as the plane which contains this center line and the bow string 511.

As is conventional, the riser section 505 has a hand grip portion 513 (FIG. 21) adapted to be grasped by the left hand of the archer. The hand grip portion 513 is located on the left side (as seen by the archer) of the plane of the bow. Just above it and offset to the right of the portion 513 is the offset bow window portion 515 that includes a flat vertical wall (often called the "arrow plate") 517 that is substantially parallel to and located slightly to the right of the plane of the bow.

Figure 29:
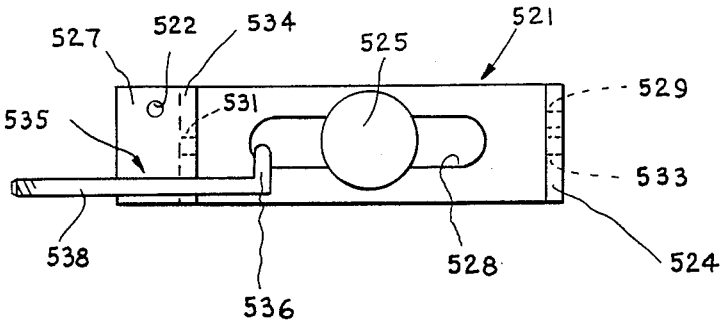
FIG. 29 is a side view of the pivotal loader frame showing a stage in its formation.
Figure 30:
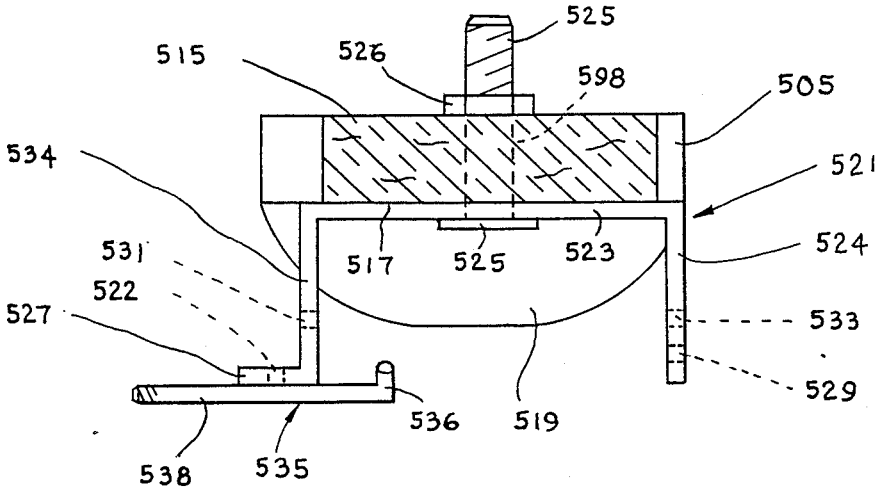
FIG. 30 is a top plan view (with the bow in section) of the loader frame shown in FIG. 29.

The arrow holder and loader 501 of this modification of the invention has a support frame 521 (FIGS. 29 and 30) to secure it to bow riser 505. It may be formed from sheet metal and have a flat vertical plate section 523 that is in solid contact with wall 517 and securely clamped against it by a bolt 525 and nut 526. Bolt 525 extends through hole 598 in portion 515. Bolt hole 528 is elongated so the attachment of loader 501 can be adjusted since not all bows on the open market have the same size and shape of a bow handle riser. Bolt 525 is of the carriage bolt design to prevent turning in slot 528. Shims may be used between wall 517 of riser 505 and plate 523 to correctly align loader 501 in relation to the plane of the bow. The support frame 521 has a flat plate section 524 which projects at right angles to vertical plate 523 so that it extends to the left of wall 517. Plate 524 is attached at the rear of plate 523. The support frame 521 also includes flat plate section 534 which projects at right angles to vertical plate section 523 so that it extends to the left of wall 517. Plates 524 and 534 are parallel to each other as seen in FIGS. 29 and 30. Front plate 534 has a flange section 527 which projects at right angles. It extends beyond the front of plate 534 and is parallel to plate 523. Plate 524 has hole 533 which corresponds to hole 531 in plate 534.

Figure 27:
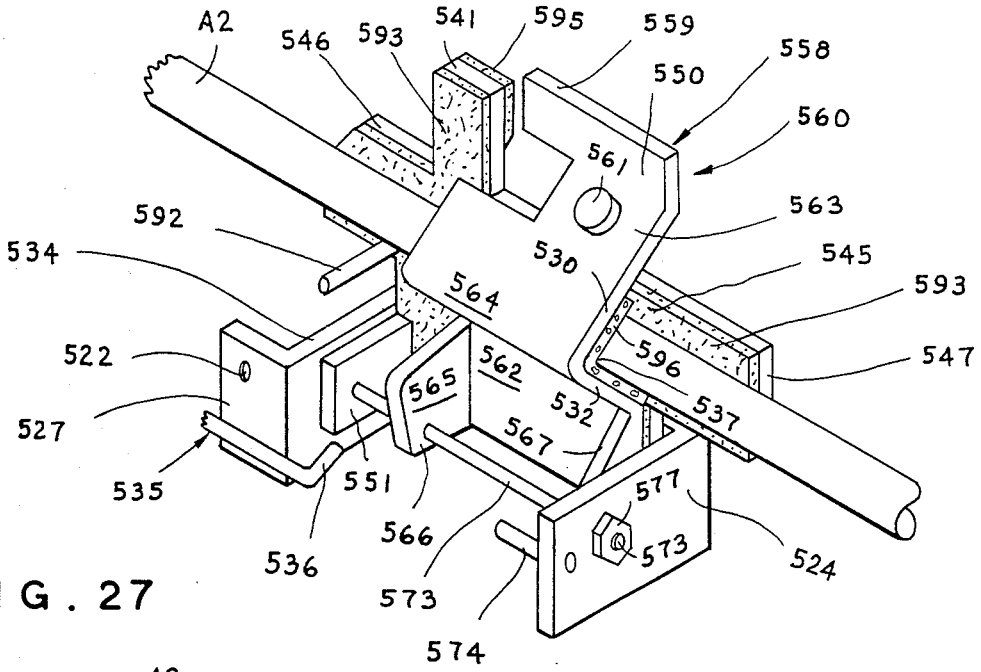
FIG. 27 is a perspective view (with structure omitted) showing the release operation of the pivotal arrow holder latch mechanism.
Figure 28:
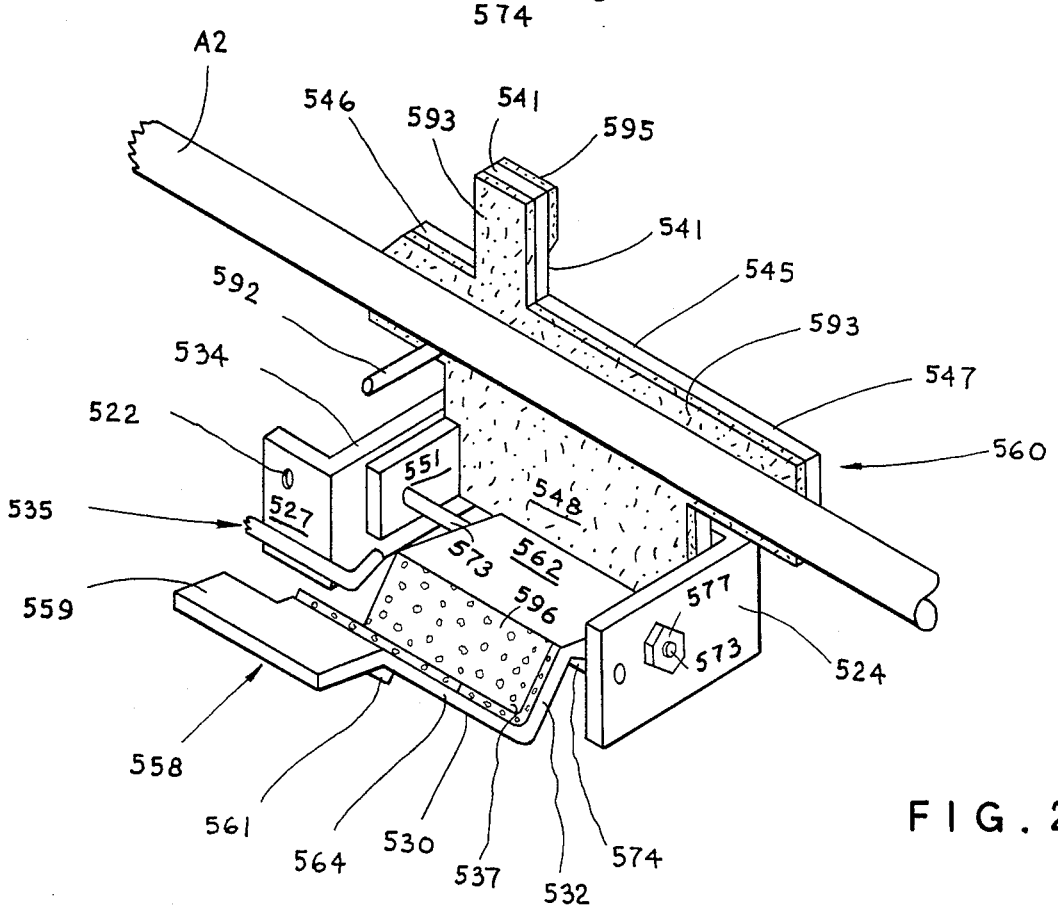
FIG. 28 is a perspective view similar to FIG. 27 but showing the arrow holding means in the release position.
Figure 31:
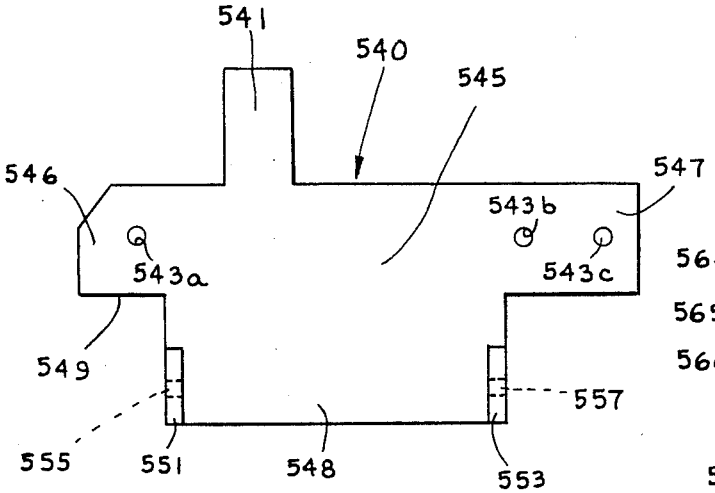
FIG. 31 is a side view of the pivotal loader carriage plate showing a stage in its formation.

One of the main parts of the carriage assembly 560 (FIGS. 22–28) is flat plate section 540 herein referred to as the carriage plate and best seen in FIGS. 28 and 31. At the top of carriage plate 540 is an attached rectangular plate section 541 which will be designated as a latch plate or wall. At the front of plate 540 is an extended portion 546 with hole **543*a*. Section 547 extends back toward the archer and also has holes 543*b* and 543*c* and for reference will be called an anchor plate. Between sections 546 and 547 is portion 545 or an arrow alignment wall. Riser section 548 has a flange 553 at the rear and flange 551 at the front. Both flanges project at right angles from plate 540 and are parallel to each other. Flange 551 can clearly be seen extending from plate 540 in FIGS. 23, 24, 27, and 28. Flange 553 extends in the same way but is hidden from view. Hole 557 of flange 553 is coaxial with and corresponds to hole 555 in flange 551**.

Figure 32:
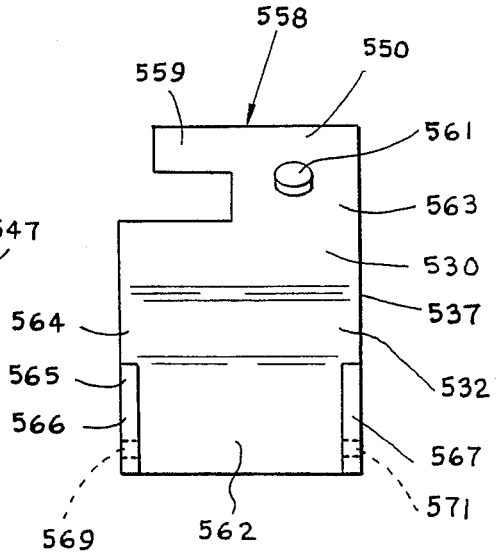
FIG. 32 is a side view of the pivotal arrow holder showing a stage in its formation.

The other main part of carriage assembly 560 is arrow holder 558 shown unassembled in FIG. 32. Riser 562 has a flange 567 at the rear which projects leftward at right angles. There is another flange 566 at the front of riser 562 which also projects leftward at right angles.

Figure 22:
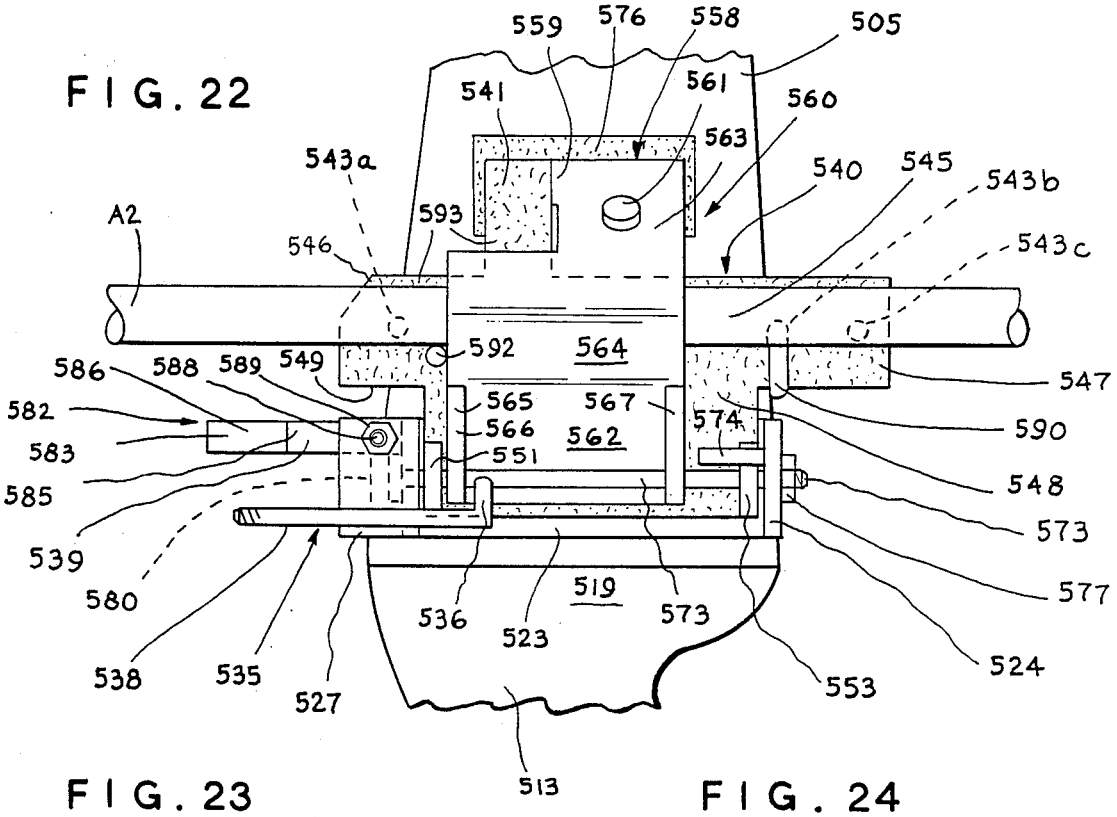
FIG. 22 is an enlarged side elevation of the pivotal loader of FIG. 21 secured to an archery bow (with parts omitted) and arrow A2 held firmly in the arrow holder.
Figure 23:
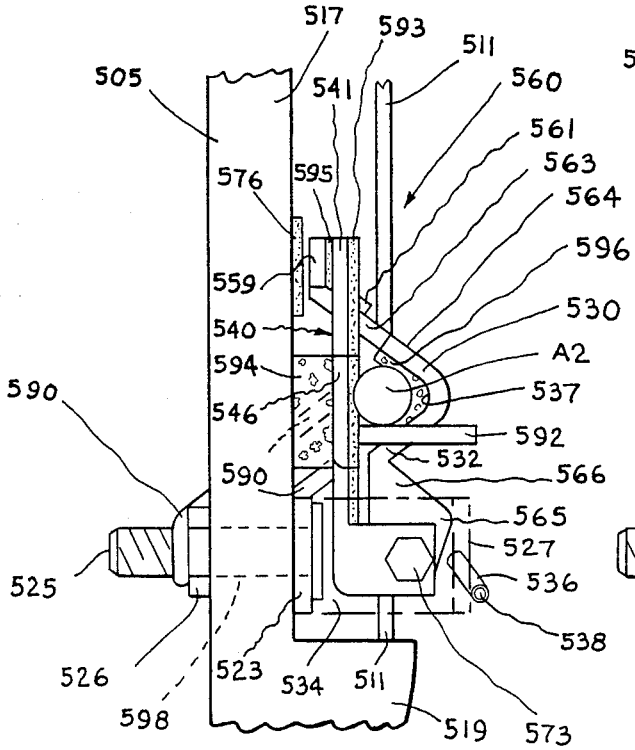
FIG. 23 is a front view of the loader of FIGS. 21–22 bolted to an archery bow shown in FIG. 22.
Figure 24:
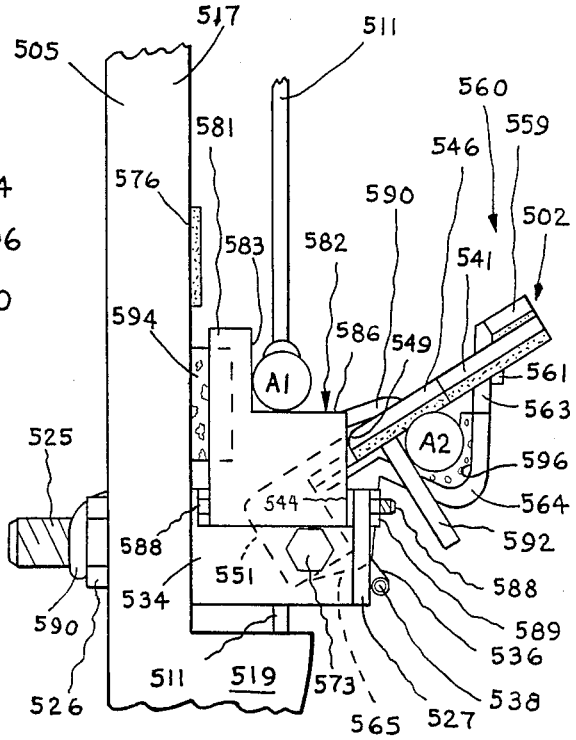
FIG. 24 is similar to FIG. 23 but shows the carriage with A2 pivoted to a storage position and A1 in place to be drawn and released by the archer.

Flange 567 has hole 571 which corresponds to (i.e., is coaxial with) hole 569 in flange 566. Flange 566 also has an extended section 565 (best seen in FIGS. 23, 26, and 27) which is cam-like in shape. Above riser 562 is arrow clamp section 564 whcih has a top flat plate 530 and bottom flat plate 532 which forms trough 537 as shown in FIG. 28. Riser 563 follows the same plane as top plate 530 of clamp 564 (FIGS. 22 and 27). Bolt 561 screws into a hole (not shown) in riser 563. The top 550 of riser 563 is bent so that it is in a vertical plane that runs parallel to riser 562 (FIGS. 23 and 24). This bent section 550 continues forward and past riser 563 to form rectangularly shaped portion 559 which serves as a latch arm of latch mechanism 502 (FIGS. 23–27).

To assemble the carriage 560 (FIG. 22), plate 540 (FIG. 31) must be placed vertically between plates 524 and 534 of support frame 521 (FIGS. 29 and 30). Plate 540 should be positioned so that it is in a vertical parallel plane with vertical plate 523 of support frame 521 and with flanges 553 and 551 extending leftward from wall 517 as are plates 524 and 534. Carriage plate 540 is constructed so that flanges 553 and 551 fit with close tolerance between plates 524 and 534, respectively. Arrow holder 558 can then be positioned in a somewhat vertical position with its flanges 567 and 566 also extending leftward from wall 517 and between flanges 553 and 551 respectively of plate 540. Holes 533, 557, 571, 569, 555, and 531 must be positioned in corresponding alignment so that bolt 573 (FIGS. 22 and 27) can be inserted. Retention nut 577 is screwed on the threaded end of bolt 573 which extends past plate 524 of support frame 521. Except for the section that extends past plate 524, bolt 573 has a smooth shaft so arrow holder 558 can easily pivot or slide back and forth between flanges 553 and 551. FIGS. 22 and 23 show carriage 560 fully assembled and mounted on frame 521 which is secured to bow handle riser 505 by bolt 525 and nut 526. It is in the vertical position with arrow A2 firmly clamped between arrow holder 558 and carriage plate 540.

In order to have arrow A2 in the clamped position, first the arrow holder 558 must be in the open position as shown in FIG. 28. The front portion of arrow A2 is then rested upon A2 arrow rest 592 extending from plate 540 while the back portion of A2 with the nock is positioned for pre-nocking on the string 511. Arrow holder 558 is then pivoted on the smooth shaft of bolt 573 to the right, best seen in FIG. 27, and pushed firmly against arrow A2 which is against carriage plate 540. Since arrow holder 558 has rightward pressure against it, a forward push against bolt head 561 is all that is needed to get arrow A2 in the stored position. Trough 537 is lined with cork 596 or other gripping material. The front of carriage plate 540 has a soft, non-metallic, sound-deadening material 593 (such as material identified as "Velcro") adhered to it. The back of latch wall 541 of carriage plate 540 also has corresponding "Velcro" material 595 adhered to it. When arrow holder 558 is pushed forward, it slides about ⅜ inches on bolt shaft 573. Latch arm 559, which is an integral part of arrow holder 558, simultaneously slides behind latch wall 541 of carriage plate 540 thereby locking clamp 564 against arrow A2. Another occurrence during the forward push of arrow holder 558, is that arrow A2 is pulled along the same distance because it's gripped by corklining 596. The smooth "Velcro" 593 on the front of carriage plate 540 allows A2 to easily slide against it while it is carried along with arrow holder 558. FIGS. 23, 24, and 26 clearly show arrow A2 in the clamped position, pressured between trough 537 with corklining 596 and alignment wall 545 with "Velcro" covering 593. When latch arm 559 is behind "Velcro" 595 and latch wall 541, arrow A2 is locked under constant pressure.

Figure 25:
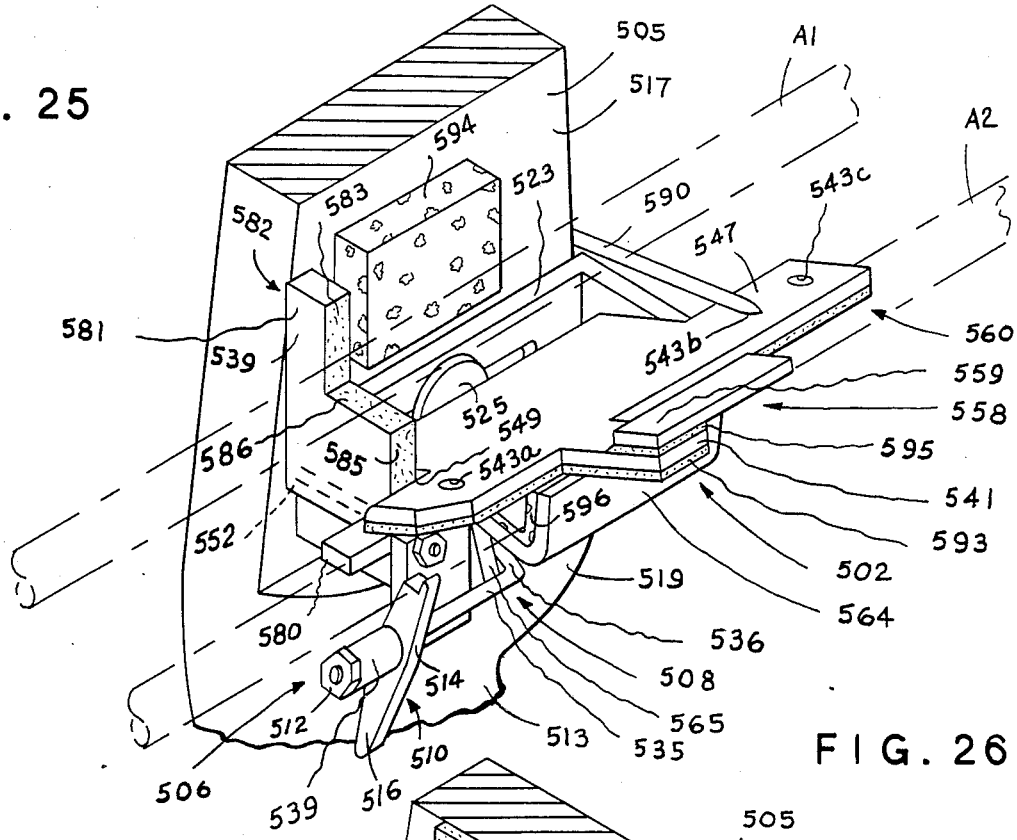
FIG. 25 is a perspective view of FIG. 24 but includes a carriage safety lock (arrow rest 592 not shown for clarity of arrow holder retention means)
Figure 26:
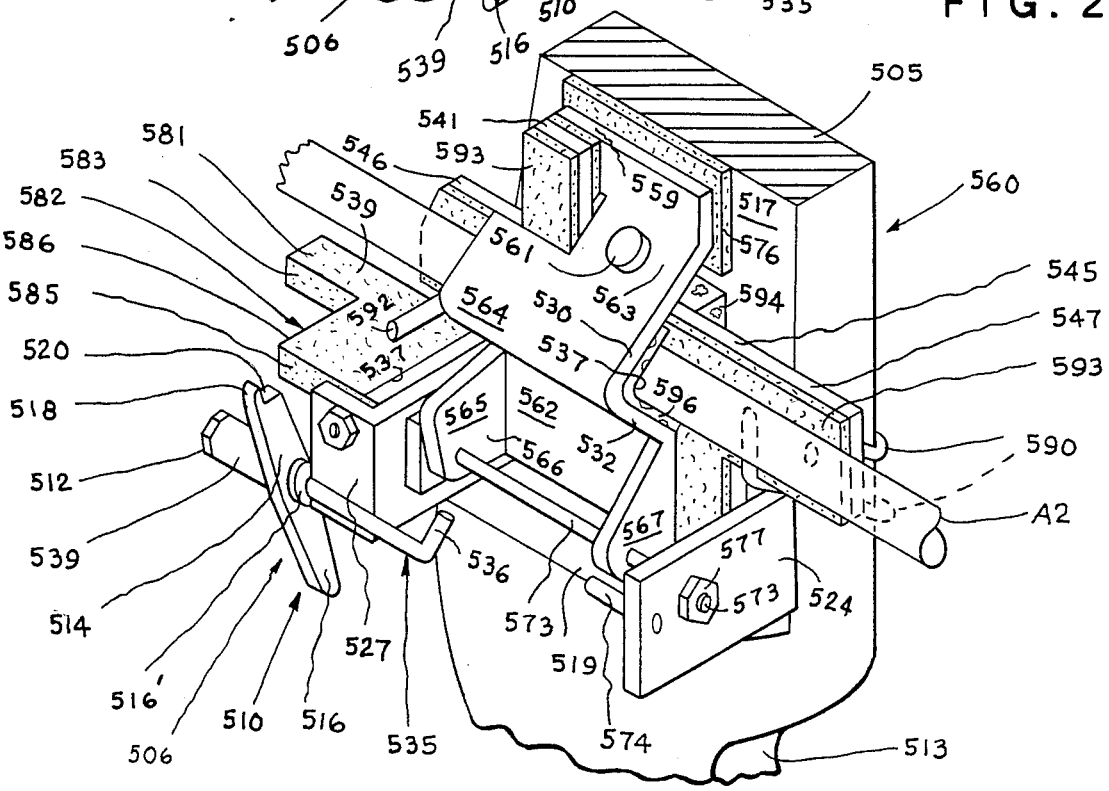
FIG. 26 is a perspective view of the loader of FIGS. 22 and 23 with the carriage pivoted into position for release of the second arrow.

After A2 has been firmly clamped in carriage assembly 560, it can then be put in the stored position (FIGS. 24 and 25). The stored position can be achieved by pivoting the carriage assembly 560 on bolt shaft 573 to the left as seen by the archer. Since it is preferred that the loader 501 work automatically, a spring motor means brings carriage assembly 560 and arrow A2 from the stored position to a vertical nocking position. The motor means is looped elastic cord 590 (FIGS. 22–26). One end of elastic cord 590 is threaded through one of the holes 543 which is most convenient in relation to the riser of the bow being used. The two ends of elastic cord are then fastened together to make a loop. The length should be such that when stretched it will be able to pivot carriage assembly 560 with clamped arrow A2 from the stored position to the uppermost vertical position. Since elastic cord 590 is looped through anchor plate 547 by means of hole **543*b*, it needs only to be trained around the back and right side of bow handle riser 505 and looped around the threaded end of bolt 525 in order to be operational. When A2 is clamped against wall 545, it pushes the relatively soft elastic cord 590 into the soft "Velcro" 593. Therefore, the alignment of arrow A2 is not affected by elastic cord 590 passing underneath A2 (FIGS. 22 and 26). As the archer pivots the carriage assembly 560 with A2 leftward and down, elastic cord 590** is stretched and then resiliently urges the carriage assembly back to the vertical position.

Arrow A2 must stay in the stored position and out of the way until arrow A1 has been drawn and released. As soon as A1 has been released, it is desired that A2 be brought to the nocking, drawing and shooting position. Pivoting plate 582, which is perpendicular to the plane of the bow, when in the up position (FIGS. 24 and 25), blocks carriage 560 from pivoting to the vertical position. Bolt 588 has a smooth shaft except for the threaded end extending past flange 527. Bolt 588 shaft is slightly larger than the threaded end. Parallel and near the bottom of plate 582, hole 552 runs the full sideways length (FIG. 25). Bolt 588 is pushed through hole 552 in plate 582 from the right (archer's view) and then the threaded end is screwed into hole 522. Because the shaft of bolt 588 is larger than the threaded end, it will screw into hole 522 only the desired distance. Washer 544 separates plate 582 from mounting flange 527. Retention nut 589 prevents bolt 588 from working loose.

Ledge 586 of plate 582 functions as an arrow rest for arrow A1 as seen in FIGS. 24 and 25. It is covered with "Velcro" 539 (FIGS. 25–26) so that the bottom fletching or vane of A1 is protected as it passes over and pushes down plate 582. On the back side (the side facing the archer) of plate 582 the "Velcro" extends down and is cut off at the appropriate length so its edge 537 (FIG. 26) will serve as a stop for plate 582 when it is put in the up position.

It is important for consistent shooting that arrows A1 and A2 be drawn and released on the same plane. Therefore, arrow rest 586 must be at the same height in relation to the nocking point on the string 511 as is arrow rest 592 when it is in the up position. Also, for consistent shooting, A1 and A2 must be the same distance from bow handle wall 517. The distance of A2 from wall 517 is determined by the space needed by the loader 501. Arrow A1 is held the same distance from wall 517 as arrow A2 by rectangular portion 581 (FIGS. 23 and 24) of plate 582. Leftward facing wall 583 serves as a guide for arrow A1. Sections 581 and 583 are also covered with a "Velcro" layer 539 for sound deadening and protection of the top vane of arrow A1.

Assuming arrow A2 is firmly clamped between the arrow holder 558 and carriage plate 540, the archer pivots the carriage assembly 560 leftward and down. Next, plate 582 is manually pivoted to the up position. The archer releases leftward pressure upon the carriage assembly 560 and it is urged back to the vertical position. However, it is stopped from returning to the up position because bottom right edge 549, which is an integral part of the carriage assembly 560, has come into contact with and is pressed against the left side of plate 582 (FIGS. 24 and 25). The pressure not only keeps carriage 560 in the desired position, but also prevents plate 582 from falling forward and down. The left side of plate 582 functions as stop face 585 and is also covered with a "Velcro" layer 539 to facilitate an easy and quiet release of carriage assembly 560. Edge 549 of carriage plate 540 is rounded to further help with an easy separation of stop face 585 and edge 549.

Now that carriage 560 is mechanically held in the down position and arrow A2 is stored out of the way, arrow A1 may be positioned on string 511 and arrow rest 586. After both arrows are loaded, the archer (whether hunter or one involved in a competitive sport) may feel the need to move around. With movement there is the possibility of the front portion of arrow A1 bouncing which could push down pivot plate 582 thereby disengaging stop face 585 from edge 549. Disengagement would cause an unwanted return of carriage assembly 560 to the vertical position. Arrow A1 would be caught between wall 517 and the back of carriage plate 540 making both arrows unusable at that instant. To prevent an accidental carriage 560 release, the present invention has as one of its parts locking device 506 shown in FIGS. 25 and 26. Locking device 506 is in the form of a flat bar and a lever. Bar 580 extends forward in a near perpendicular manner from the front side of plate 582 and close to stop face side 585 as seen in FIGS. 22 and 25. Lever 510 is pivotally mounted on shaft 538 (FIGS. 29 and 30). It is separated from flange 527 by washer 516' and its tightness or looseness is controlled by self-tightening nut 512. At the top of riser 514 of lever 510 is flat surface 520 and wall 518 (FIG. 26). The handle portion can be operated by the forefinger of the left hand (assuming the archer is using a right-handed bow). If the archer decided to lock pivot plate 582, handle 516 would be pushed leftward thereby pivoting flat surface or stop face 520 under bar 580 and would be positioned correctly by wall 518. Plate 582 can be unlocked by pushing handle 516 to the right which causes stop face 520 to be pivoted leftward and out from under bar 580.

Again, if an archer (especially a hunter in a wooded area) is moving around with arrows A1 and A2 on bow 503, stored arrow A2 could accidentally be pushed back. Arrow holder 558 would also be slidably pushed back because of its grip on arrow A2. If arrow holder 558 is pushed back ⅜ inch or so, latch arm 559 would no longer be locked behind latch wall 541 (FIG. 22). Arrow holder 558 would automatically pivot leftward releasing its grip on arrow A2. Locking mechanism 508 (FIG. 25) limits the backward movement of arrow holder 558 when in the down position to about ⅛ inch. Support rod 535 is attached (as by welding) to the left side parallel with and near the bottom of flange 527 (FIG. 29 and 30). The extended front of rod 535 serves as support for lever 510 as previously described. Rear extended portion 536 of rod 535 is bent at a right angle so that is is perpendicular to frame attachment plate 523. Bent portion 536 angles upward at about 50 degrees and acts as a retention rod. Front flange 566 of arrow holder 558 has an extended section 565 which is somewhat cam-shaped and can best be seen in FIGS. 23 and 27. In order for locking mechanism 508 to be operational, arrow holder 558 must be in the down storage position and wall 565 in front of retention rod 536 (FIGS. 24 and 25). If arrow A2 and consequently arrow holder 558 are accidentally pushed back; the backward movement is stopped when wall 565 contacts retention rod 536. This prevents arrow holder 558 from releasing its grip on stored arrow A2. The loader is operationally ready if: A2 is angularly positioned to correctly fit over string 511; latch mechanism 502 has arrow holder 558 locked in place around arrow A2; carriage 560 is locked in the storage position by stop face 585; the top of lever 510 has been pivoted left to the unlocked mode; and A1 is nocked on string 511 and resting on arrow rest 586 (FIG. 29).

After the archer performs the above preliminary steps, he draws back and releases A1. As arrow A1 passes over arrow rest 586, the bottom vane or other radial projection pushes down on plate 582 and causes it to pivot far enough forward and down so that stop face 585 disengages edge 549. The release is smooth because stop face 585 and arrow rest 586 are covered with "Velcro" layers 539, and edge 549 is rounded. Since carriage 560 is no longer blocked, it is immediately pivoted by stored energy in stretched elastic cord 590 on shaft 573 rightward to the vertical position (FIG. 26). Sponge 594 and "Velcro" layer 576 are adhered to wall 517 and help to absorb the shock as carriage 560 is stopped by wall 517 of bow handle riser 505. Sponge 594 is of selected thickness so that after absorbing the shock, it will push carriage 560 back out to correct shooting position. When carriage 560 is in the vertical position, wall 565 will not come into contact with retention rod 536. Therefore, carriage 560 is free to be slidably moved back. Arrow A2 nock has now either engaged string 511 (depending upon the type of nock used), or is close enough to be easily nocked by the archer. Trough 537 is corklined and is tight against arrow A2, therefore, as A2 is pulled back so is arrow holder 558. Wall 546, alignment wall 545, and anchor wall 547 are covered with "Velcro" layers 593 which are smooth and prevent any binding as A2 is pulled back. "Velcro" layer 595, which is adhered to the back of latch wall 541, provides a smooth sliding surface for latch arm 559 as it is pulled back.

When arrow holder 558 has traveled back the ⅜ inch or so, latch arm 559 (an integral part of arrow holder 558) will no longer be locked behind latch wall 541 as seen in FIG. 27. Also, at this point flange 566 is clear of and will not pivot into retention rod 536. When arrow A2 was clamped in place for storage, this not only put pressure upon A2, but also upon cork lining 596, "Velcro" covering 593, and "Velcro" covering 595. Therefore, as soon as latch arm 559 clears latch wall 541, their resilience on arrow holder 558 will automatically pivot it leftward on bolt shaft 573 thereby losing its hold on A2 (FIG. 28). Cork lining 596, "Velcro" covering 593, and "Velcro" covering 595 have a tendency to return to an unpressured state and as a result, spring away from clamped arrow A2. Arrow holder 558 is prevented from falling completely down to the bow handle shelf 519 by rod 574 which is screwed into threaded hole 529 (FIGS. 27 and 28). As holder 558 released its grip on arrow A2, the front portion of A2 was held at the same elevation by arrow rest 592. The archer kept pulling back string 511 with arrow A2 nocked during the action of arrow holder 558 sliding back and pivoting leftward. When string 511 is fully drawn, arrow A2 can be released. There are different kinds of arrow rests on the open market that can be used for arrow rest 592. One that will "give" as A2 passes over is best. With the aid of loader 501, a proficient archer can shoot a second follow-up arrow within 2 or 3 seconds.

A device that permits the use of shorter arrows on conventional bows has recently gained much popularity. The device is the "overdraw" and can be purchased on the open market. It is so designed to permit an arrow rest to be mounted a few inches back from the conventional mounting position on the arrow plate section of the bow riser which means the broadhead of an arrow can be pulled back closer to the archer, i.e., shorter arrows can be used. The use of a shorter arrow means a faster arrow which results in a flatter trajectory so that the archer can have a better aiming capability. After removing the parts (arrow-rest plate, overdraw arrow guard, etc.) from the overdraw attachment arm, the present loader 501 (or loaders 1 or 301) can then be mounted to the overdraw attachment arm 554 so that shorter arrows can be used with the loader.

Figure 33:
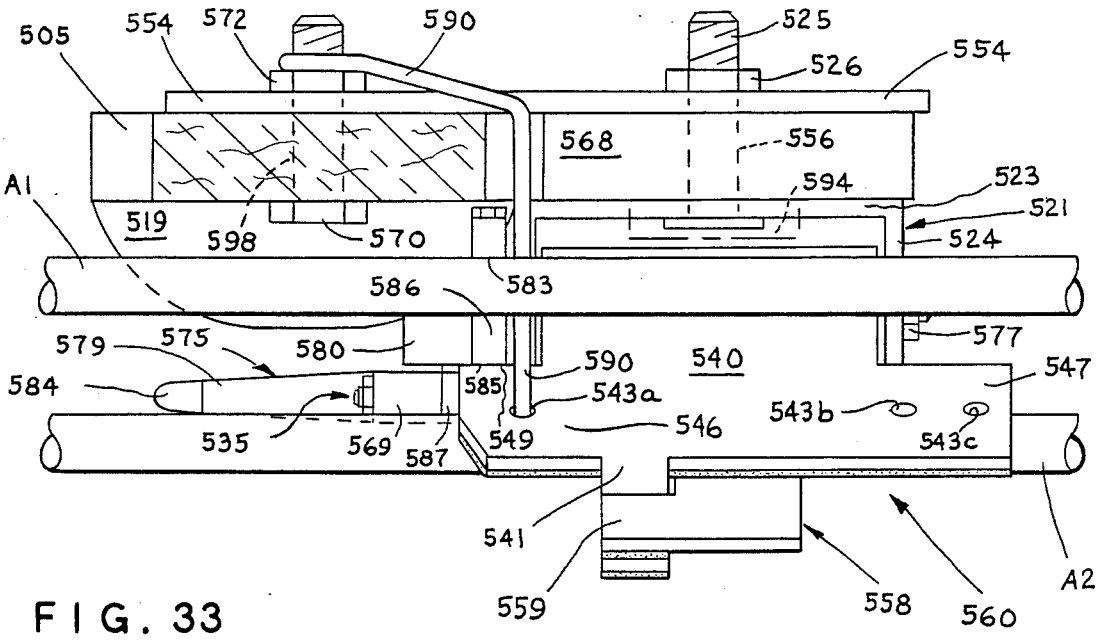
FIG. 33 is a top plan view (with bow in section) of the pivotal arrow loader mounted to an attachment arm and plate so that the loader can be mounted at the rear of the riser.
Figure 34:
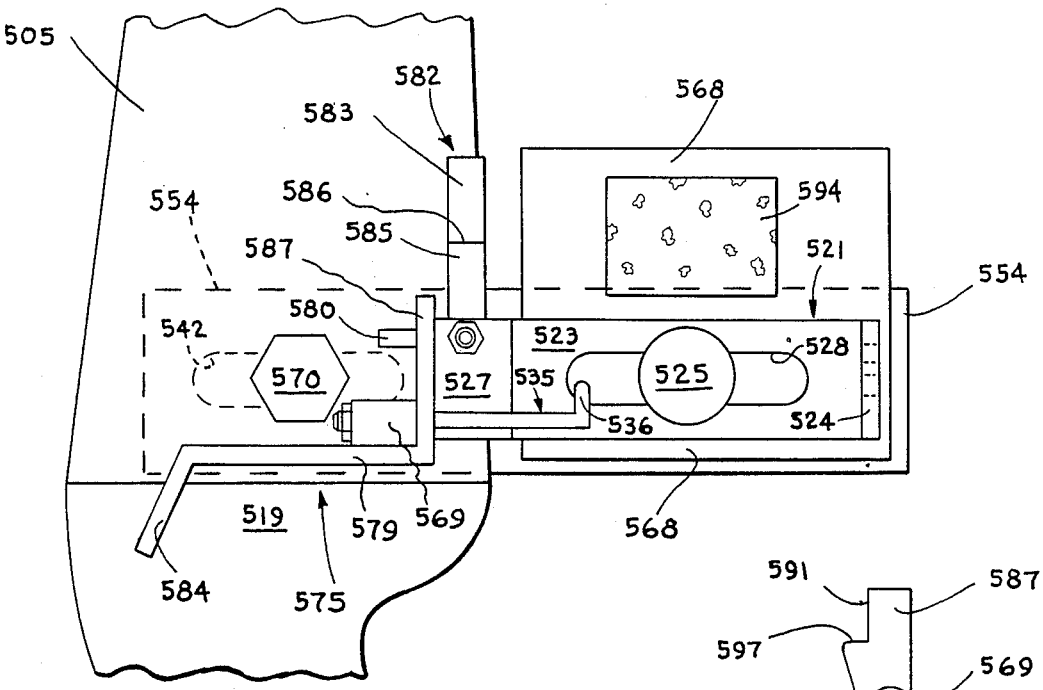
FIG. 34 is a side elevation of the loader as shown in FIG. 33 but with the carriage assembly removed so as to clearly show the attachment of the loader frame to the plate and the attachment arm.

In order for the loader 501 to be mounted to the overdraw attachment arm 554, a rectangular plate 568 (possibly made of plastic) is positioned between the loader attachment wall 523 and the attachment arm 554 (FIGS. 33 and 34). Plate 568 is wide enough (left to right thickness) so that when the loader attachment wall 523 is flat against it, the loader will be in the correct position for aligning arrows A1 and A2 in the shooting position. Plate 568 can be of various widths (thickness from left to right) to accommodate the different sizes of risers on bows. The height of plate 568 is such that it will function as a wall that will stop the rightward pivotal movement of the carriage at the vertical position so that arrow A2 will be in the shooting position. Shock absorbing sponge 594, previously attached to the left side or face of the riser 505, has been reattached to the left vertical face of plate 568. When plate 568 has been correctly positioned between plate 523 and the attachment arm 554, then carriage bolt 525 is pushed through elongated hole 528, through hole 556, then through an aligned hole in the rear section of arm 554. Nut 526 is then screwed tightly on the right end of bolt 525 so that the loader frame 521, plate 568, and attachment arm 554 are securely fastened together. At this point the front section of attachment arm 554 is placed flat against the right vertical face of riser 505. Bolt 570 is pushed through hole 598 in the bow riser 505, from the left to the right and on through elongated hole 542 in arm 554. Nut 572 is screwed on the right end of bolt 570 and tightened against arm 554. In FIG. 34 the carriage assembly 560 has been removed so as to show how the loader frame is securely mounted in the overdraw position to the bow riser 505. Hole 542 in attachment arm 554 and hole 528 in the attachment wall 523 are both elongated which allows for adjustment so that the loader can be used in the overdraw position on many different kinds of bows that have varied sizes of risers.

In FIG. 33 the loader 501 is fully assembled and operational with arrow A1 in the shooting position and arrow A2 in the stored position. Elastic cord 590 has been moved to the front hole 543 in section 546 and stretched rightward between plate 568 and the riser 505, over arm 554, pulled forward on the right side of riser 505, then anchored around the right end of bolt 570. The moving of elastic cord 590 from the back section 547 (FIG. 25) to the front section 546 (FIG. 33) would mainly depend upon a preference by the archer. The loader would still operate even if cord 590 was anchored in one of the holes in section 547, stretched and looped around the end of bolt 525.

When the loader is attached to the overdraw attachment arm, lever 510 of locking means 506 will no longer be in a convenient location for use by the archer. Therefore, lever 510 and spacer sleeve 539 are removed and locking means 575 (FIGS. 33–35) is used in place of locking means 506, and riser plate 587 corresponds to riser 514 respectively; stop face 597 corresponds to stop face 520 respectively; vertical positioning wall 591 corresponds to positioning wall 518 respectively; and, handle 584 corresponds to handle 516 respectively. The bottom of riser 587 extends forward at right angles to provide shelf portion 579 upon which is attached journal 569. The back face of journal 569 is tight against the vertical riser 587. Running longitudinally through the center of journal 569 and extending through riser 587 is hole 578 which permits the locking means 575 to be mounted on the forward extended portion of shaft 535 which was previously occupied by locking means 506 and spacer sleeve 539. Retention nut 512 is again screwed on the threaded end of shaft 535 to prevent locking means 575 from accidentally sliding off shaft 535. Journal portion 569 is part of the structure of locking means 575 to prevent canting since the handle 584 is some distance away from the pivoting point of the riser 587. Shelf 579 and/or handle 584 could be constructed so as to be longer in length thereby accommodating archers with longer and/or bigger fingers.

To review briefly, the arrow holding and loading device 501 of FIGS. 21–35 is mounted on bow 503 by means of a support frame 521. A carriage assembly 560 indexes in arched or arcuate sideways movement at right angles to the plane of the bow by pivoting on bolt shaft 573. The carriage 560 is structured so as to hold only one follow-up arrow. The first station is for the initial or first arrow A1 to be shot and is defined by guide wall 583 and arrow rest 586. The second station is for the follow-up arrow A2 and is defined by the wall 545 and arrow rest 592. It is parallel to, but transversely separated from the first station by a very short distance, preferably in the range of 1.0 to 1.5 inches or less. Since follow-up arrow A2 must be supported while initial arrow A1 is being aimed and shot and since it must be moved into the shooting position in the plane of the bow, the second station has a holding, stabilizing, and clamping means 558 for holding the follow-up arrow tightly on the carriage 560.

A latch means 502 including latch arm 559 and latch wall 541 is provided to latch the holder and stabilizer member 558 in operative position wherein the arrow is seated in a V-shaped trough 537 which is preferably sized to provide pressure to clamp the arrow A2 against face 593 and wall 545. Flat plate shims may be used between cork lining 596 and the top and bottom plates 530 and 532 of clamp 564 so that the proper amount of pressure can be applied to arrows of various sizes.

Latch arm 559 is not permitted to disengage latch wall 541 if carriage 560 is in the down and stored position because of lock means 508. When the carriage 560 is in the vertical and shooting position, then the archer can release latch arm 559 from latch wall 541.

The carriage 560 is indexed automatically in its operative direction from left to right by the elastic cord 590. However, indexing cannot occur if plate 582 is in the up position because of abutment of stop face 585 with edge 549 of section 546 (FIGS. 24 and 25). However, when an arrow A1 is released, movable plate 582 is forced forward and down by the vane, etc. on the arrow. This moves stop face 585 out of engagement with section 546 of the carriage (assuming lever 510 is not blocking plate 582). The carriage is then automatically indexed to the right until it abuts against wall 517 thereby positioning arrow A2 in the shooting position. Indexing can be prevented by manual operation of the finger actuated stop means 506 to place stop face 520 in the path of bar 580 of plate 582.

FIG. 26 shows the loader 501 an instant after the archer has released arrow A1. The radial vane or fletching of A1 has passed across arrow rest 586 which pivoted plate 582 forward and clear of section 546. Therefore, movement of the carriage 560 was no longer restricted and it pivoted from left to right so that A2 was placed in the shooting position. Now that carriage 560 is in the vertical position, locking mechanism 508 is not operative and arrow holder 558 may be pulled back. As arrow A2 is nocked and drawn back, arrow holder 558 is also drawn back (FIG. 27). As soon as latch arm 559 disengages latch wall 541, arrow holder 558 automatically pivots leftward thereby losing its grip on arrow A2 (FIG. 28).

After A2 has been shot, the device may be reloaded. This is done in reverse order because of retention rod 536. Thus, with station 2 in the vertical position arrow A2 is clamped in position on wall 545; the carriage is pivoted leftward until plate 582 can be placed in the "up" and blocking position. The first arrow to be shot, arrow A1, is loaded secondly.

Figure 35:
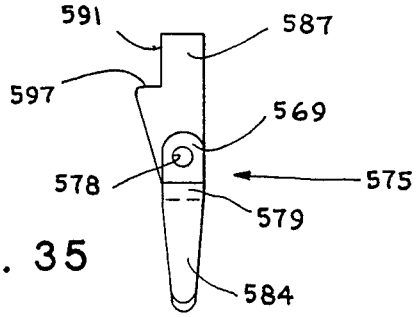
FIG. 35 is a front elevation of the locking mechanism that is used when the pivotal loader is mounted at the rear of the bow riser.

The overdraw device which can be purchased on the open market and which can be mounted on most bows, allows the use of shorter arrows which means faster arrows. A faster arrow does not fall as much in its flight to its target as does a slower arrow. Therefore, an archer using the overdraw device increases his or her aiming capability. The loader 501 (and loaders 1 and 301) can (as shown in FIGS. 33–35) be attached to the attachment arm of the overdraw device or system so that shorter faster arrows can be used with the loader.

It will be seen that the pivotal type arrow holding and loading device 501 of FIGS. 21–35 can be used with a wide variety of bows to provide an archer with a fast follow-up shot using arrow A2. The stations are very close to each other so that the arrows are only an inch or so apart. The follow-up arrow A2 is parallel to the first arrow A1 in the shooting position and need only be moved sideways by carriage 560 for an inch or so to be delivered to the shooting position from the last pre-shooting position. This small movement minimizes visual disturbance of the environment. The various metal parts can be well lubricated and/or padded to minimize noise and auditory disturbance of the environment. The automatic delivery of arrow A2, along with the small amount of sidewise movement of the arrow, enables the follow-up arrow to be nocked and shot very rapidly. The device 501 can enable the archer with experience to release follow-up arrow A2 within about two or three seconds after release of arrow A1. The fast, automatic delivery of follow-up arrow A2 also improves accuracy because the archer's attention and movements can be focused almost exclusively on shooting. It is not necessary for him or her to search for and load the follow-up arrow.

The device 501, as well as devices 1 and 301, is sturdy and compact in construction, easy and quiet to use, operates rapidly and smoothly, and can be attached to most bows. It drastically reduces the amount of time between arrow releases. It delivers the follow-up arrow consistently to the same position so that the archer can have a smooth, economical, rhythmic, hand-arm motion in shooting. The benefits to the hunter are obvious. For sport archery, the speed of the device can add another dimension to target shooting by making it possible to quickly and accurately shoot at a second target.

The arrow holding and loading devices 1, 301, and 501 that have been illustrated and described in the preceding description may be changed in form and arrangement of the individual parts. It will be appreciated that modifications of the constructions that are illustrated and described are within the broad spirit and scope of the invention.

What is claimed is:

1. An arrow holding and loading device for an archery bow having a shooting position for an arrow wherein the arrow is in appropriate alignment for nocking on the bowstring and for drawing, aiming and release by the archer, said device comprising a carriage having a first means for releasably holding a follow-up arrow in a pre-shooting position wherein said follow-up arrow is substantially parallel to but tranversely separated from an arrow in the shooting position, second means for supporting the carriage on the bow to provide for transverse movement of the carriage to move said follow-up arrow and first means from said transversely separated pre-shooting position into said shooting position, third means for the application of force to transversely move the carriage so that the follow-up arrow moves from said pre-shooting position to said shooting position, fourth means for actuating the first means to release the follow-up arrow when it is in said shooting position, and fifth means for supporting an arrow in said shooting position, said fifth means being isolated from movement of said carriage.

2. An arrow loader for an archery bow having a bow string and a shooting position for an arrow in which the arrow is axially aligned with the bow string, said loader comprising a first means for supporting a first arrow on said bow in said shooting position, a second means for supporting a follow-up arrow in a pre-shooting position parallel to said shooting position and to the first arrow, stop means for releasably holding the second means in said pre-shooting position, stop release means actuated by shooting of the first arrow for releasing the stop means and the holding of the second means in said pre-shooting position, said stop release means being isolated from moving directionally with said follow-up arrow when said follow-up arrow moves from said pre-shooting position to said shooting position, and third means operative upon release of the stop means for moving the follow-up arrow into the shooting position wherein the follow-up arrow is axially aligned with the bow string.

3. The arrow loader claim 2, wherein said first means for supporting a first arrow comprises an alignment wall.

4. The arrow loader of claim 3, wherein said stop means comprises an arm.

5. The arrow loader of claim 2, wherein said stop means comprises an arm.

6. The arrow loader of claim 2, further comprising a spacer pad operable to define said shooting position.

7. The arrow loader of claim 2, wherein said third means moves said follow-up arrow in an arcuate path upon release of said stop means.

8. The arrow loader of claim 2, further comprising a frame having a shelf on the front thereof to provide support for said follow-up arrow in said pre-shooting position.

9. An arrow holder and loader for an archery bow having a bow string and a shooting position for an arrow in which the arrow is axially aligned with the bow string, said loader comprising a frame and having a first means for supporting a first arrow in said shooting position, a carriage mounted on the frame for movement transverse to the shooting position and having a second means for releasably supporting a follow-up arrow in a pre-shooting position parallel to said shooting position and to said first arrow, said first means for supporting a first arrow being isolated from said transverse movement of said carriage and third means for moving the carriage on the frame to carry the follow-up arrow along a path of sidewise movement of the follow-up arrow from said pre-shooting position into said shooting position wherein the follow-up arrow is axially aligned with the bow string.

10. An arrow holder and loader as set forth in claim 9 wherein said carriage is pivotally mounted on said frame.

11. An arrow holder and loader as set forth in claim 9 wherein said carriage is mounted on said frame for rectilinear movement.

12. An arrow holder and loader as set forth in claim 9 wherein said bow has a riser with a window through it in a plane parallel to said shooting position, said carriage being movable through said window.

13. An arrow holder and loader as set forth in claim 12 wherein said frame is detachably mounted on said bow and including plug means for closing said window when the frame is detached from the bow.

14. An arrow holder and loader as set forth in claim 9 wherein said bow has an overdraw device for supporting an arrow to the rear of the bow, said frame being mounted on said overdraw device whereby said first and follow-up arrows are supported at the rear of the bow.

15. An arrow holder and loader as set forth in claim 9 wherein said second means comprises an arrow alignment wall means and an arrow holder and clamp movable with the wall means and with respect to the wall means for releasably clamping said follow-up arrow against said wall means.

16. An arrow holder and loader as set forth in claim 15 wherein said alignment wall means and said arrow holder and clamp have cooperative latch members thereon providing a latch mechanism for releasably clamping said follow-up arrow against said wall means.

17. An arrow holder and loader as set forth in claim 16 wherein said latch mechanism is operatd to release the arrow holder and clamp by rearward movement of the clamp relative to the wall means.

18. An arrow holder and loader as set forth in claim 5 including a retention member blocking rearward unlatching movement of the clamp when the follow-up arrow is in the pre-shooting position.

19. An arrow holder and loader as set forth in claim 5 including a movable stop element engageable with the alignment wall means to block movement of the alignment wall means away from the pre-shooting position, said stop element being movable out of engagement with the wall means by force from shooting of the first arrow.

20. An arrow holder and loader as set forth in claim 19 wherein said movable stop element forms a part of said first means.

21. An arrow holder and loader as set forth in claim 19 including resilient sound and shock absorbing means positioned to contact moving parts and yieldably urge them toward functioning positions.

22. An arrow holder and loader as set forth in claim 3 including an arrow rest for said follow-up arrow attached to said alignment wall means.

23. An arrow holder and loader as set forth in claim 9 including a locking means operated by the finger of an archer for releasably locking the carriage against movement relative to the frame.

24. An arrow holder and loader as set forth in claim 9 wherein said first means includes an arrow rest for supporting the first and follow-up arrows in said shooting position.

25. An arrow holder and loader as set forth in claim 24 wherein said arrow rest is movable and has a stop element engageable with the carriage to block carriage movement toward the shooting position, said arrow rest being movable to move the stop element out of carriage blocking position by force from shooting of an arrow.

26. An arrow holder and loader as set forth in claim 9 including a movable stop element engageable with the carriage to block carriage movement toward the shooting position, said stop element being movable out of carriage blocking position by force from shooting of an arrow.

27. An arrow holder and loader as set forth in claim 26 wherein said carriage has a fourth means for releasably supporting a second follow-up arrow in a pre-shooting position parallel to said shooting position and to said first arrow, and including fifth means operated by movement of the carriage toward the shooting position for moving said stop element back into carriage blocking position.

28. An arrow holder and loader as set forth in claim 21 wherein said first means comprises a movable arrow rest for shooting the first arrow and the follow-up arrows in shooting position, said stop element being connected to and movable by said arrow rest.

29. An arrow holder and loader as set forth in claim 14 wherein said bow has a riser and said frame is attached to the riser to provide for movement of the carriage behind the riser and transversely across a vertical plane defined by the riser.

30. An arrow holder and loader as set forth in claim 26 wherein said first means comprises a movable arrow rest, said stop element being connected to and movable by said arrow rest.

31. An arrow holder and loader as set forth in claim 30 wherein said carriage includes an arrow rest for supporting the follow-up arrow in said shooting position.

32. An arrow holder and loader as set forth in claim 9 including an elastic cord that is stretched during loading of the follow-up arrow to provide power for moving the carriage to carry the follow-up arrow to the shooting position.

33. An arrrow holder and loader as set forth in claim 9 wherein said bow has a riser and said frame provides for positioning of the carriage to the rear of the riser.

34. An arrow holder and loader as set forth in claim 9 wherein said frame has a shelf on the front thereof to provide support for the follow-up arrow in the pre-shooting position.

* * * * *